US011885125B2

(12) United States Patent
Newbrough

(10) Patent No.: US 11,885,125 B2
(45) Date of Patent: Jan. 30, 2024

(54) METHOD AND SYSTEM FOR FRONT-LOAD BAY

(71) Applicant: Oldcastle BuildingEnvelope, Inc., Plano, TX (US)

(72) Inventor: Tim Newbrough, Terrell, TX (US)

(73) Assignee: Oldcastle BuildingEnvelope, Inc., Plano, TX (US)

( * ) Notice: Subject to any disclaimer, the term of this patent is extended or adjusted under 35 U.S.C. 154(b) by 104 days.

(21) Appl. No.: 17/321,611

(22) Filed: May 17, 2021

(65) Prior Publication Data

US 2021/0355679 A1 Nov. 18, 2021

Related U.S. Application Data

(60) Provisional application No. 63/026,565, filed on May 18, 2020.

(51) Int. Cl.
*E04B 2/92* (2006.01)
*E04B 2/96* (2006.01)

(52) U.S. Cl.
CPC ..... *E04B 2/92* (2013.01); *E04B 2/967* (2013.01)

(58) Field of Classification Search
None
See application file for complete search history.

(56) References Cited

U.S. PATENT DOCUMENTS 2,885,040 A * 5/1959 Grossman ..... E04B 2/96 52/656.1
3,037,591 A * 6/1962 Pulling ..... E04B 2/965 52/204.591
3,466,826 A * 9/1969 Gallagher ..... E06B 3/26336 52/235
4,141,188 A * 2/1979 Sukolics ..... E06B 7/14 52/204.593
4,619,092 A * 10/1986 Kaminaga ..... E04B 2/96 52/302.1
4,724,637 A * 2/1988 Evans ..... E06B 1/36 52/235
5,105,593 A * 4/1992 Kaminaga ..... E04B 2/90 52/235
5,253,459 A * 10/1993 Parinas ..... E04B 2/96 52/235
5,355,645 A * 10/1994 Farag ..... E06B 3/5427 52/235

(Continued)

*Primary Examiner* — Joshua K Ihezie
(74) *Attorney, Agent, or Firm* — Henry Patent Law Firm PLLC

(57) ABSTRACT

An exterior wall system includes a pair of split vertical members. A front-load bay is defined between the pair of split vertical members. The front-load bay includes a horizontal member disposed along a bottom edge of the front-load bay. Each split vertical member includes a removable portion coupled to a vertical edge of the front-load bay and a fixed portion coupled to an adjacent section of the exterior wall system. The removable portion may be selectively coupled to the fixed portion to facilitate assembly of the front-load bay to the adjacent section of the exterior wall system. A sill starter is disposed horizontally between the pair of split vertical members below the front-load bay. The horizontal member engages with the sill starter to facilitate support of the front-load bay.

20 Claims, 17 Drawing Sheets

(56) References Cited

U.S. PATENT DOCUMENTS

| | | | | |
|---|---|---|---|---|
| 5,381,637 | A * | 1/1995 | Farag | E06B 3/5427 52/204.593 |
| 5,937,597 | A * | 8/1999 | Sono | E06B 1/36 52/235 |
| 6,158,182 | A * | 12/2000 | Biebuyck | E04B 2/96 52/235 |
| 6,993,873 | B2 * | 2/2006 | Biebuyck | E04B 2/96 52/844 |
| 7,389,617 | B2 * | 6/2008 | Grunewald | E04B 2/96 52/843 |
| 7,827,746 | B2 | 11/2010 | Speck | |
| 7,922,224 | B2 | 4/2011 | Arias | |
| 8,341,901 | B2 | 1/2013 | Loyd | |
| 8,833,017 | B1 | 9/2014 | Huang | |
| 8,991,121 | B1 * | 3/2015 | Baker | E04B 2/965 52/656.1 |
| 9,212,481 | B2 | 12/2015 | Stramandinoli | |
| 10,202,764 | B2 | 2/2019 | Levan | |
| 10,526,791 | B2 | 1/2020 | Loyd | |
| 11,377,854 | B2 | 7/2022 | Loyd | |
| 11,434,635 | B1 * | 9/2022 | Frederick | E04B 2/56 |
| 2004/0074174 | A1 * | 4/2004 | Biebuyck | E04B 2/96 52/235 |
| 2021/0404181 | A1 * | 12/2021 | Naim Ibrahim | E06B 3/60 |

* cited by examiner

METHOD AND SYSTEM FOR FRONT-LOAD BAY

CROSS-REFERENCE TO RELATED APPLICATION

This application claims priority to, and incorporates by reference the entire disclosure of, U.S. Provisional Patent Application No. 63/026,565, filed on May 18, 2020.

TECHNICAL FIELD

The present disclosure relates generally to architectural exterior wall systems and, more particularly, but not by way of limitation to a mountable and de-mountable front-load bay for use in an architectural exterior wall system.

BACKGROUND

This section provides background information to facilitate a better understanding of the various aspects of the disclosure. It should be understood that the statements in this section of this document are to be read in this light, and not as admissions of prior art.

Exterior wall systems such as curtain walls and window walls are frequently utilized in architecture and construction projects. A curtain wall is one type of outer covering for a building that does not support the roof or floor loads. A curtain wall is generally installed over the exterior face of a building's intermediate floor slabs and, thus, allows for designs that minimize the space between adjacent rows of glass panels so as to present a more continuous exterior glass surface. Various types of curtain wall systems exist including, captured curtain-wall systems and structurally glazed curtain-wall systems. These systems generally include a network of curtain-wall members. The curtain-wall members often include horizontal members (e.g. transoms) and vertical members (e.g. mullions) with panel members, often glass, disposed within the network. Window walls, in contrast, are secured between floor slabs and, thus, generally present a less continuous exterior glass surface. During construction, it is often necessary for a portion of the exterior wall system to be removable (i.e. de-mountable) or remain incomplete in order to accommodate, for example, delivery of large equipment to the interior of the building or to facilitate the use of construction equipment such as a skip hoist or a trash chute. In situations where the exterior wall system remains incomplete or is otherwise omitted, the incomplete portion of the exterior wall system must be completed during the later stages of construction when other contiguous portions of the exterior wall system have been installed. This becomes problematic particularly in the case of unitized framing systems, which have a particular order, sequence, and direction of installation such as, for example, left to right. In such unitized framing systems, it is often necessary to install the omitted portion of the exterior wall system by sliding glazing panels from top to bottom between the vertical members. Such an installation methodology may preclude removal altogether and, in the case of omitted portions, cause tearing of the gaskets between the glazing panels and the vertical members when such omitted portions are later installed. This can leave the glazing panels in the exterior wall system inadequately sealed (i.e. less energy efficient and subject to water penetration) with little opportunity for repair.

SUMMARY

Various aspects of the disclosure relate to an exterior wall system. The exterior wall system includes a pair of split vertical members. A front-load bay is defined between the pair of split vertical members. The front-load bay includes a horizontal member disposed along a bottom edge of the front-load bay. Each split vertical member includes a removable portion coupled to a vertical edge of the front-load bay and a fixed portion coupled to an adjacent section of the exterior wall system. The removable portion may be selectively coupled to the fixed portion to facilitate assembly of the front-load bay to the adjacent section of the exterior wall system. A sill starter or an intermediate horizontal is disposed horizontally between the pair of split vertical members below the front-load bay. The horizontal member engages with the sill starter to facilitate support of the front-load bay.

Various aspects of the disclosure relate to an exterior wall front-load bay. The exterior wall front-load bay includes a horizontal member disposed along a bottom edge of the front-load bay. The horizontal member has a recess formed in a bottom face thereof. A sill starter spans the front-load bay horizontally and is positioned below the horizontal member. The sill starter includes a base plate arranged in a spaced relationship to a substrate, an inner angular member positioned above the base plate, and an outer angular member positioned above the base plate and that abuts the inner angular member. A locking cap joins the inner angular member and the outer angular member. The locking cap is received into the recess. A locking bracket couples to the horizontal member and secures the horizontal member to the sill starter.

Various aspects of the disclosure relate to a split vertical member for use in an exterior wall system. The split vertical member includes a removable portion and fixed portion that receives the removable portion and is operatively coupled to the removable portion. The fixed includes a first flange extending from a body section and a second flange extending from the body section. The second flange includes a recess formed therein. A third flange extends from the body section. The removable portion includes a first removable flange extending from a body section. The first removable flange aligning with the first flange of the fixed portion when the removable portion is assembled to the fixed portion. A second removable flange extends from the body section, the second removable flange having a second gasket associated therewith that, when assembled is received into the recess. T third removable flange extends from the body section. The third removable flange aligns with the third flange of the fixed portion when the removable portion is assembled to the fixed portion.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Various embodiments will now be described more fully with reference to the accompanying drawings. The disclosure may, however, be embodied in many different forms and should not be construed as limited to the embodiments set forth herein.

Figure 1A:
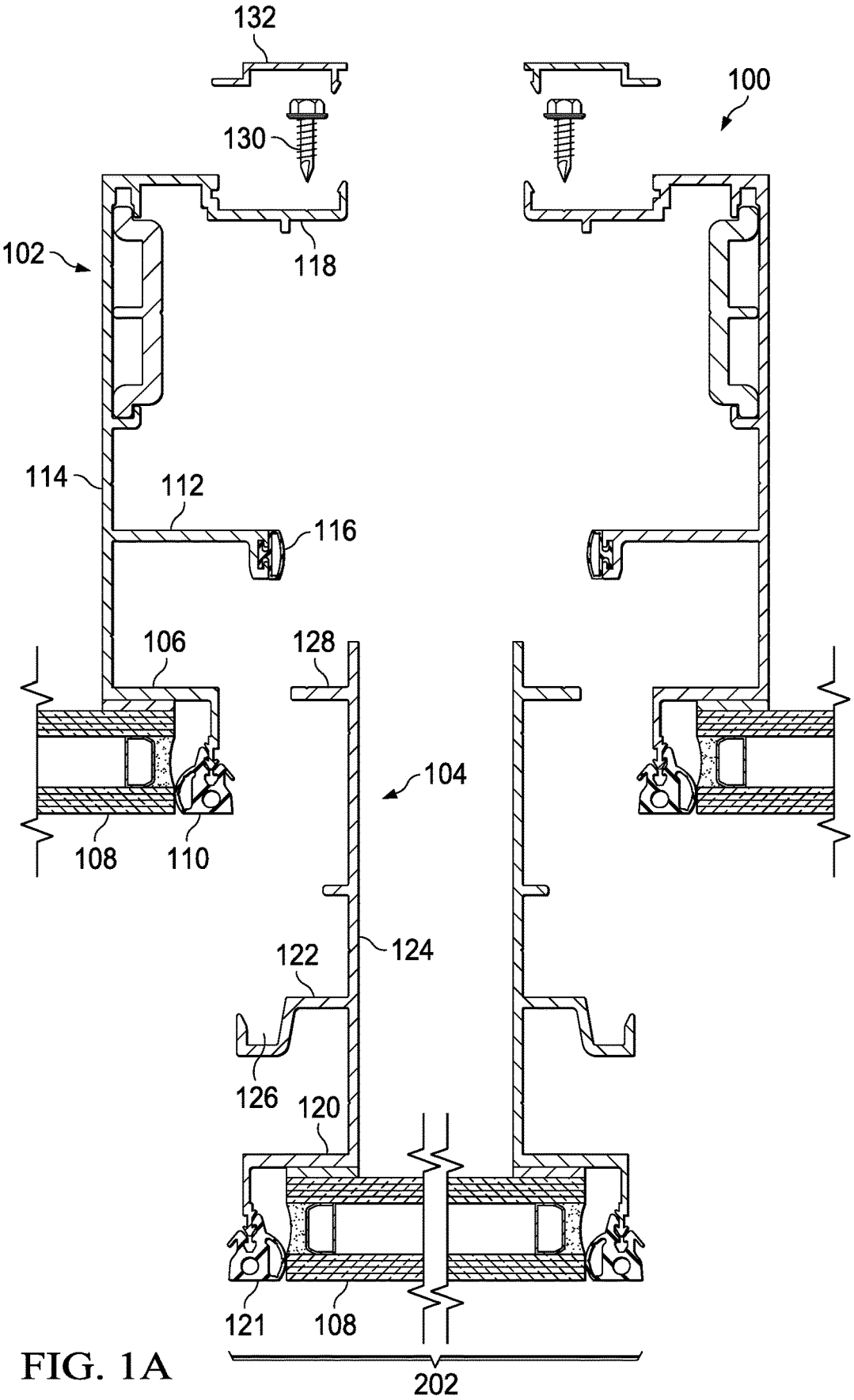
FIG. 1A is a top cross-sectional view of a split vertical member in a disengaged configuration according to aspects of the disclosure.

FIG. 1A is a top cross-sectional view of a split vertical member 100 in a disengaged configuration. The split vertical member 100 includes a fixed portion 102 and a removable portion 104. The fixed portion 102 includes a first flange 106 that extends from a forward aspect (i.e. toward the building exterior) of the fixed portion 102. The first flange 106 may, in various embodiments, be positioned around at least one glazing panel 108. A first gasket 110 is disposed on the first flange 106 and is in contact with the at least one glazing panel 108. In various embodiments, the first gasket 110 is constructed of a thermally insulating material such as, for example rubber, silicone, or any other suitable natural or synthetic polymer, or combinations thereof. The first gasket 110 is illustrated in FIG. 1A as being coupled to the first flange 106 via a combination of friction coupling with a compatible sealant (i.e. a sealant that is appropriate for use with all material with which it comes into contact). For example, in the case of the first flange 106 being made from extruded aluminum and the first gasket 110 being made of extruded ethylene propylenediene monomer (EPDM) rubber or a silicone-based gasket, one compatible sealant would be a neutral-cure silicone sealant. A neutral-cure sealant utilizes humidity present in ambient air as a catalyst for curing of the silicone. However, in other embodiments, the first gasket 110 may be coupled to the first flange 106 via friction coupling (including, for example, lock-strip or press-on gaskets) alone, solely with one or more sealants, or other adhesives (including, for example, glue or tape), or with any compatible combinations of the foregoing. Additionally, the at least one glazing panel 108 is illustrated in FIG. 1A as including two glazing panels 108 assembled as a glass unit filled with air or a gas such as, for example, argon, krypton, or xenon; however, in other embodiments, the at least one glazing panel 108 may include any number of glazing panels, that may or may not include an insulating glass unit, having a single glazing panel. The at least one glazing panel 108 may further include laminated or tempered glass. Further, in FIG. 1A, the at least one glazing panel 108 is illustrated as being coupled to the fixed portion 102 or the removable portion 104 utilizing, for example, structural glazing tape with high bonding strength suitable for structural glazing applications. In other embodiments, the at least one glazing panel 108 may be coupled to the fixed portion 102 or the removable portion 104 using a bead of, for example, structural silicone or other appropriate adhesive. In various embodiments, such adhesive could be, for example, a two-component neutral-cure, fast-curing structural sealant intended for structural bonding of glass, metal, or other building components. In other embodiments, the adhesive could be, for example, a single-component adhesive.

Still referring to FIG. 1A, the fixed portion 102 further includes a second flange 112 that extends laterally from a body section 114 of the fixed portion 102. The second flange 112 includes a second gasket 116. In various embodiments, the second gasket 116 is constructed of a thermally insulating material such as, for example rubber, silicone, or any other suitable natural or synthetic polymer, or combinations thereof. The second gasket 116 is illustrated in FIG. 1A as being coupled to the second flange 112 via a friction coupling; however, in other embodiments, the second gasket 116 may be coupled to the second flange 112 via, for example, one or more adhesives or some combination of friction coupling and one or more adhesives. Still referring to FIG. 1A, the fixed portion 102 further includes a third flange 118 that extends laterally from a body section 114 of the fixed portion 102.

Figure 1B:
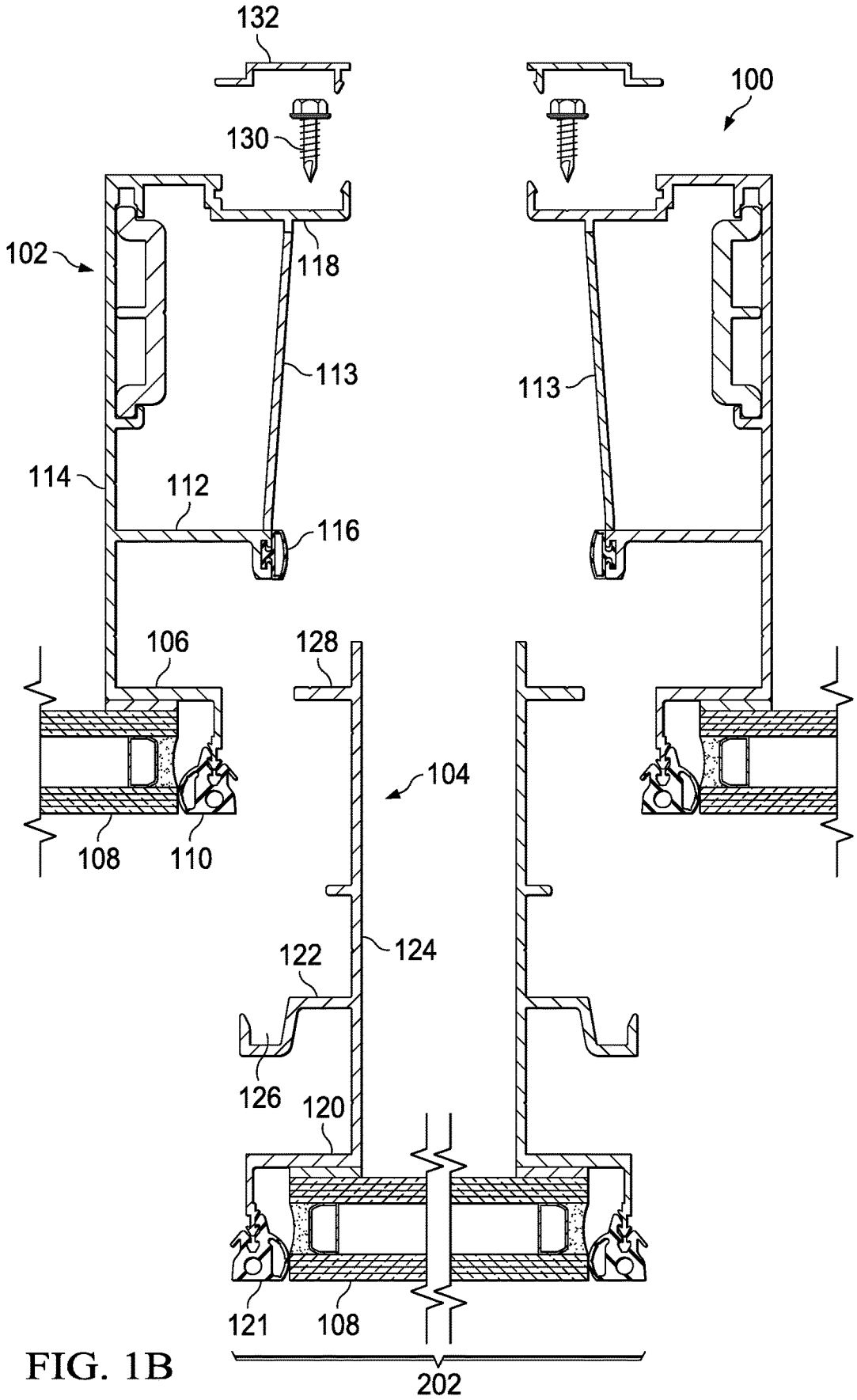
FIG. 1B is a top cross-sectional view of a split vertical member in a disengaged configuration according to aspects of the disclosure.

Still referring to FIG. 1A, the removable portion 104 includes a first removable flange 120. The first removable flange 120 is similar in construction to the first flange 106 and is formed around at least one glazing panel 108. A third gasket 121 is disposed on the first removable flange 120. In various embodiments, the third gasket 121 is similar in construction to the first gasket 110 and may be coupled to the first removable flange 120 by any of the means described above with reference to the first flange 106. The removable portion 104 further includes a second removable flange 122 that extends laterally from a body section 124 of the removable portion 104. The second removable flange 122 includes a recessed portion 126 formed therein. The removable portion 104 includes a third removable flange 128 that extends laterally from the body section 124. In other embodiments, various configurations of rails, tracks, rollers, or other guides may be used to aid in alignment during assembly and disassembly of the front-load bay 202. In one such configuration, illustrated by way of example in FIG. 1B, one or more rails 113 may extend between the second flange 112 and the third flange 118 to guide the third removable flange 128 toward or away from the third flange 118 as the front-load bay 202 is moved into or out of position by a crane. In various other embodiments, a reinforcing member may be coupled to at least one of the fixed portion 102 and the removable portion 104 to prevent buckling of the split vertical member 100 and to prevent shattering of the at least one glazing panel 108. In such embodiments, the reinforcing member may be constructed from, for example, steel or other appropriate reinforcing material.

Figure 1C:
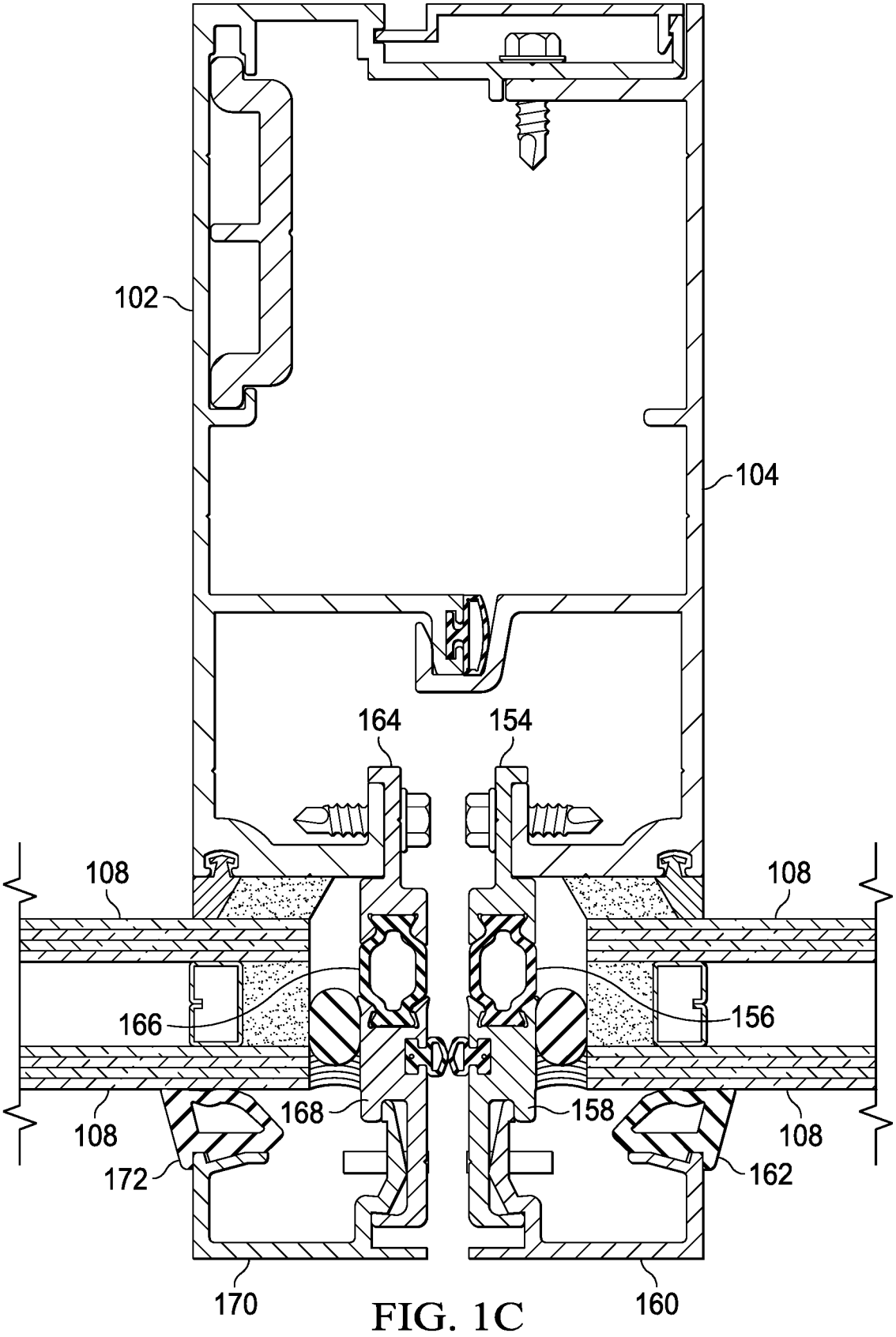
FIG. 1C is a top cross-sectional view of a front aspect of a split vertical member illustrating face caps according to aspects of the disclosure.
Figure 1D:
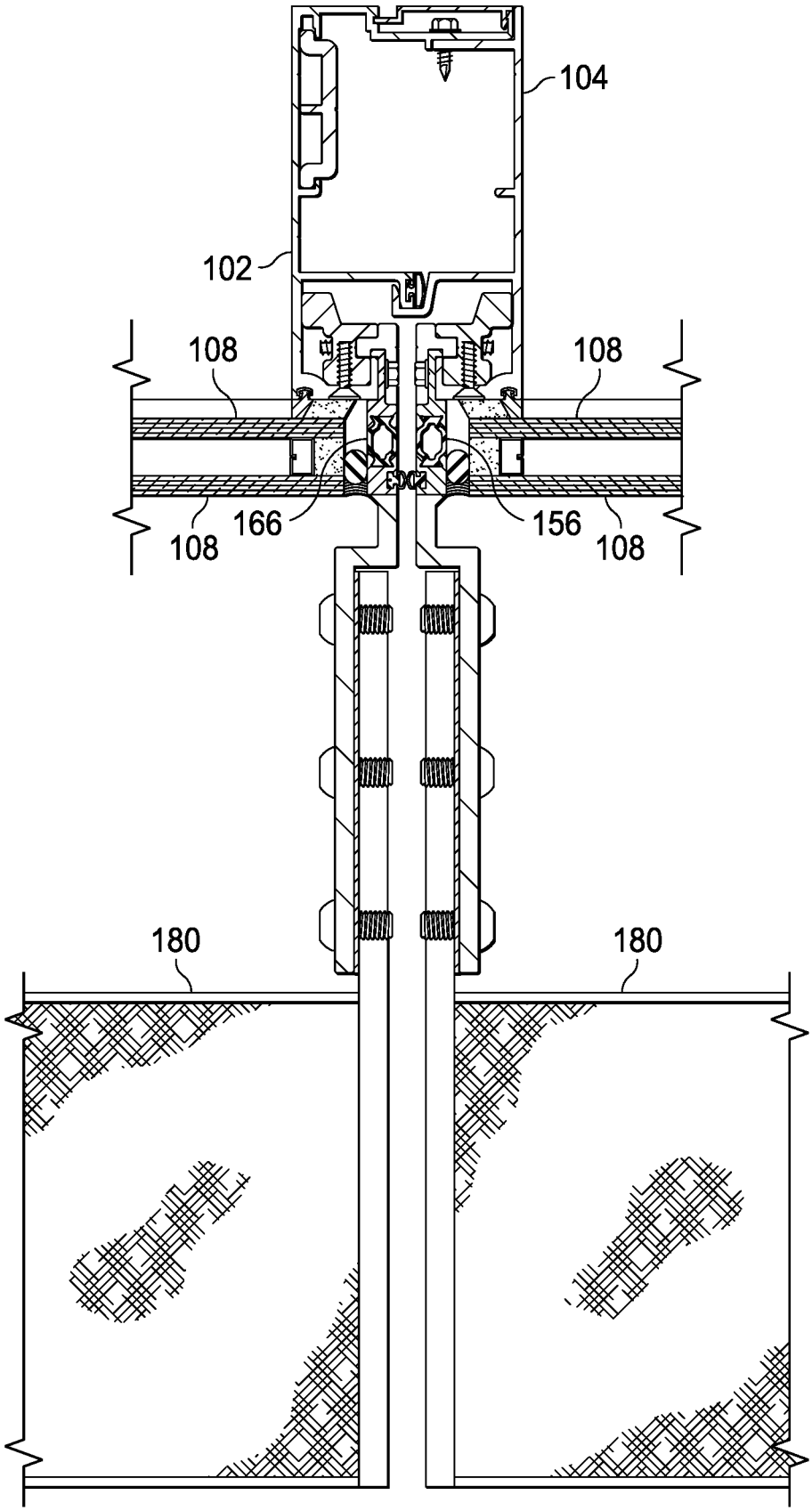
FIG. 1D is a top cross-sectional view of a front aspect of a split vertical member illustrating a sun shade according to aspects of the disclosure.

FIG. 1C is a top cross-sectional view of a front aspect of a split vertical member 150 illustrating face caps 152. The at least one glazing panel 108 is coupled to at least one of the removable portion 104 and the fixed portion 102 via, for example, structural glazing tape or a bead of structural adhesive such as, for example, structural silicone. The removable portion 104 is coupled to an interior clip 154. A thermal barrier 156 couples the interior clip to an exterior clip 158. A face cap 160 is coupled to the exterior clip 158 and a compression gasket 162 is disposed between the face cap 160 and the at least one glazing panel 108. Similarly, the fixed portion 102 is coupled to an interior clip 164. A thermal barrier 166 couples the interior clip to an exterior clip 168. A face cap 170 is coupled to the exterior clip 168 and a compression gasket 172 is disposed between the face cap 170 and the at least one glazing panel 108. When the removable portion 104 is coupled to the fixed portion 102, the face cap 160 aligns with the face cap 170 to create the appearance of a smooth intermediate section between adjacent glazing panels 108. FIG. 1D is a top cross-sectional view of a front aspect of a split vertical member illustrating a sun shade 180. In various embodiments, the thermal barrier 166 of the fixed portion 102 is coupled to the sun shade 180 in lieu of the exterior clip 168 and the face cap 170. Similarly, the thermal barrier 156 of the removable portion 104 is coupled to the sun shade 180 in lieu of the exterior clip 158 and the face cap 160. During operation, the sun shade 180 reduces sunlight that is directly incident on the at least one glazing panel 108 and improves energy efficiency of the building.

Figure 1E:
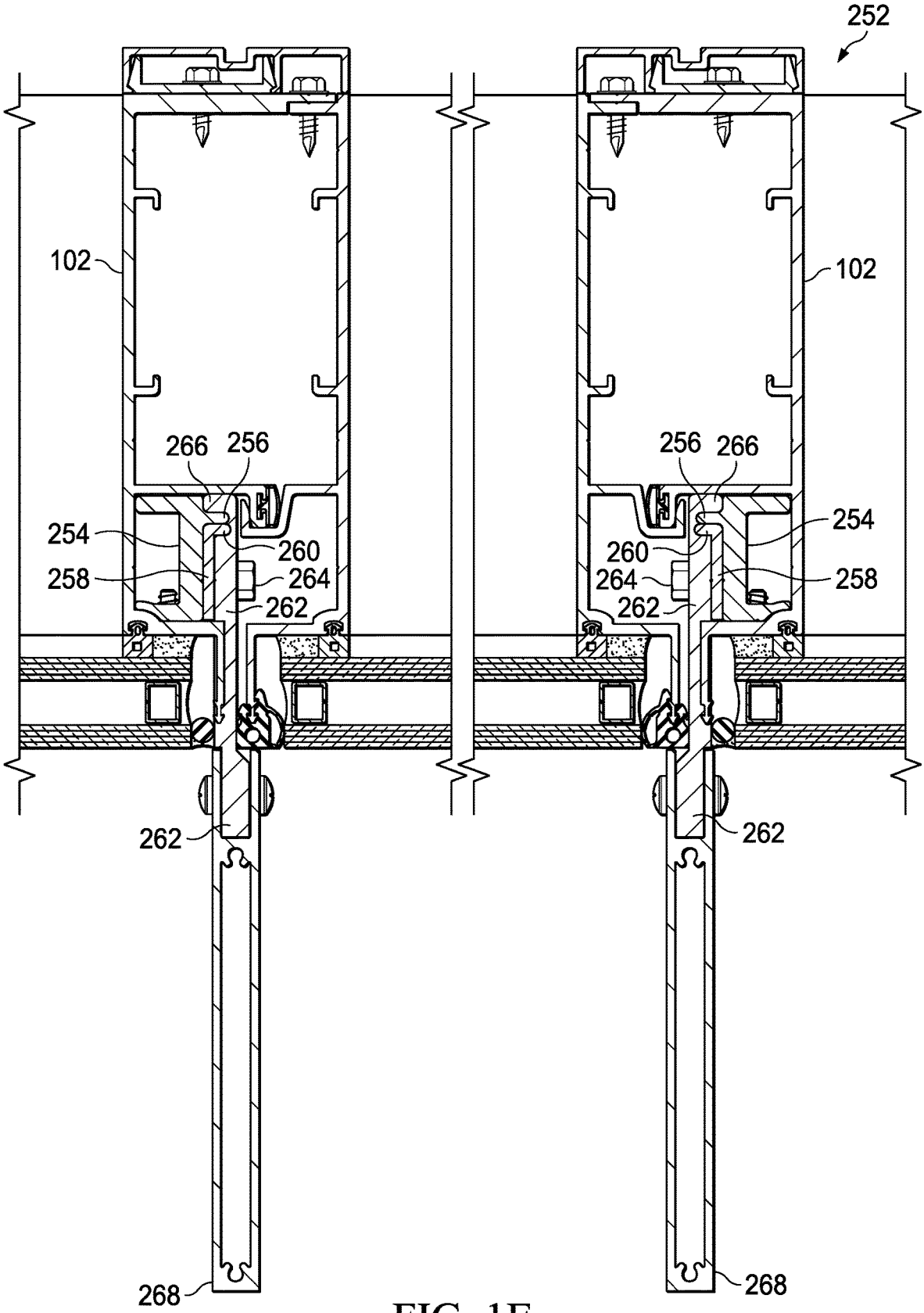
FIG. 1E is a top cross-sectional view of a split vertical member with a sun shade according to aspects of the disclosure.

FIG. 1E illustrates a top cross-sectional view of a split vertical member 250 with a sun shade 252. The split vertical member 250 is similar in construction to the split vertical member 100; however, the first flange 106 has been removed from the fixed portion 102. A channel 254 is positioned forward of the second flange 112. The channel 254 includes a flange 256 that protrudes laterally therefrom. A thermal barrier 258 abuts the channel 254 and includes a flange 260 that is complementary to the flange 256. A stem 262 is coupled to the thermal barrier 258 and the channel 254 by a fastener 264. The stem 262 includes a flange 266. When assembled, the flange 266 engages the flange 256 and the flange 260. Engagement of the flange 266 with the flange 256 and the flange 260 facilitates the support of downward loads on the stem 262. Once assembled, the stem 262 protrudes outwardly in front of the glazing panels 108 for connection of, for example, a sun shade 268. In various embodiments, the stem 262 could facilitate attachment of other structures. The split vertical member 250 and the associated sun shade 268 differ from the sun shade 180 shown in FIG. 1D in that the sun shade 180 is pre-installed prior to assembly of the curtain wall whereas the sun shade 268 is installed after assembly of the curtain wall.

Figure 2A:
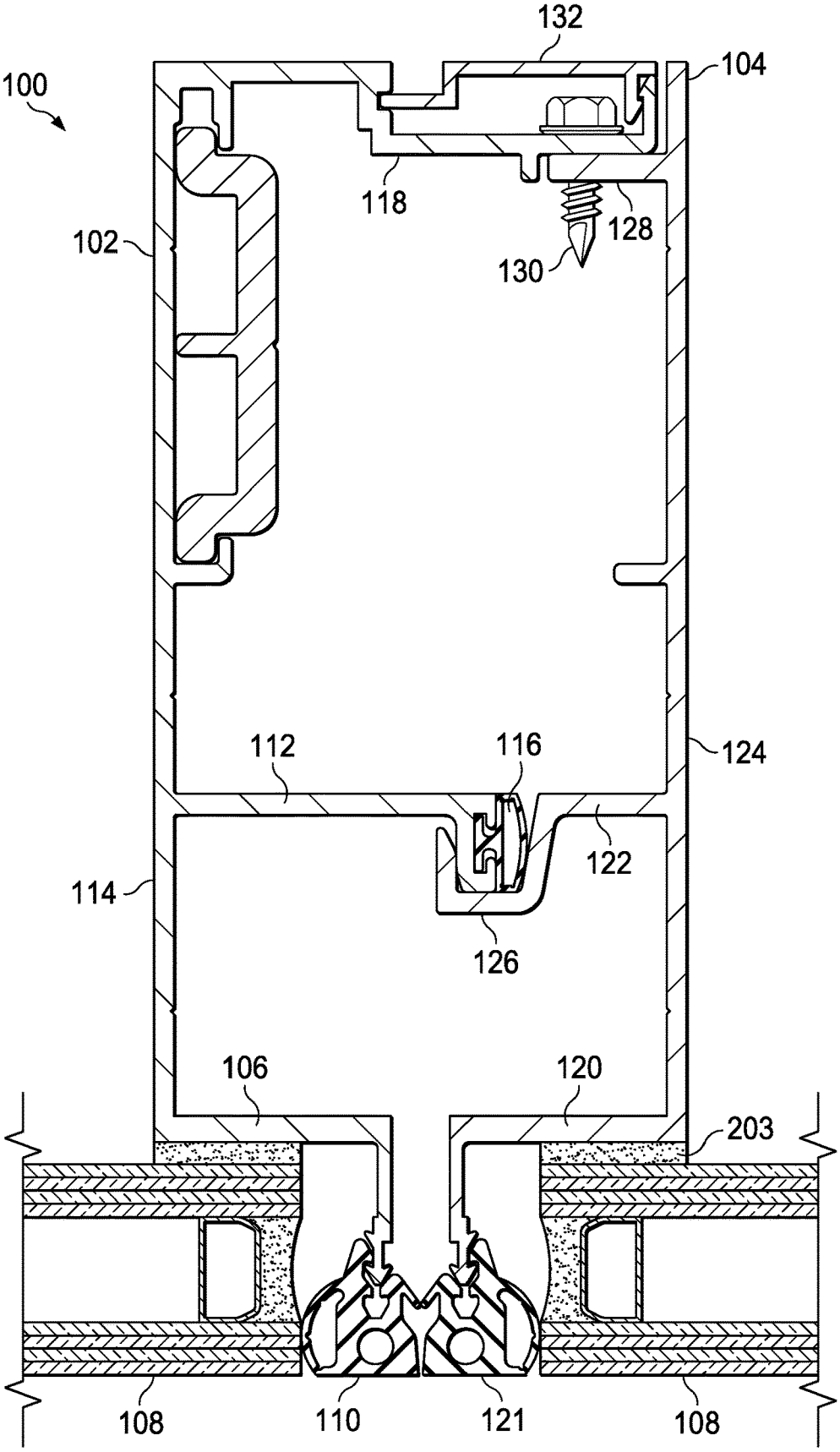
FIG. 2A is a top cross-sectional view of the split vertical member in an engaged configuration according to aspects of the disclosure illustrating use of structural glazing tape.

FIG. 2A is a top cross-sectional view of the split vertical member 100 in an engaged configuration illustrating structural glazing tape 203. During assembly of the removable portion 104 to the fixed portion 102, the third removable flange 128 of the removable portion 104 abuts the third flange 118 of the fixed portion 102 and is secured thereto with a fastener 130. By way of example, the fastener 130 is illustrated in FIG. 2A as being a machine screw; however, in various embodiments, the fastener 130 could be, for example, a rivet, a bolt, a clamp, a clip, or any other type of fastener. Additionally or alternatively, the third removable flange 128 of the removable portion 104 may be secured to the third flange 118 of the fixed portion 102 via other securement means such as, for example, welding, brazing, soldering, adhesives (e.g. epoxy, polyurethane, or cyanoacrylate), nanoscale sculpturing, or any other means capable of withstanding the applicable design loads. To the extent that the split vertical member 100 is used in an application requiring it to be assembled, disassembled, and reassembled (e.g. when installing large equipment in a building post-construction), the securement means chosen for the initial assembly would need to be capable of removal in order for the split vertical member 100 to be later disassembled. However, in applications in which no further or future disassembly need be accommodated, the split vertical member 100 may utilize more permanent securement means. The second removable flange 122 aligns with the second flange 112 of the fixed portion 102. The second gasket 116 is received into the recessed portion 126 of the second removable flange 122. In various embodiments, the interface of the second gasket 116 with the recessed portion 126 provides a frictional engagement between the second flange 112 of the fixed portion 102 and the second removable flange 122. When the removable portion 104 is assembled to the fixed portion 102 the first gasket 110 abuts the third gasket 121 in order to create a seal between the first gasket 110 and the third gasket 121. One of ordinary skill in the art will appreciate that any wet-glaze or dry-glaze methods, or combinations thereof, may be used to seal the joint between the glazing panels 108. For example, a wet seal or cap bead may be applied to the joint (e.g. over a back-up rod or glazing tape), a frame may be mounted over the joint and secured to at least one of the first flange 106 and the first removable flange 120 with gaskets inserted between the exterior side of the glazing panel 108 and the frame, or a sealant may be applied to the abutment of the first gasket 110 and the third gasket 121 to strengthen the seal between them. Such other methods may be more or less desirable, depending upon whether any future disassembly needs to be accommodated. In various embodiments, a cover 132 may be applied to the third flange 118 of the fixed portion 102 in order to conceal a head region of the fastener 130 or other securement means.

Figure 2B:
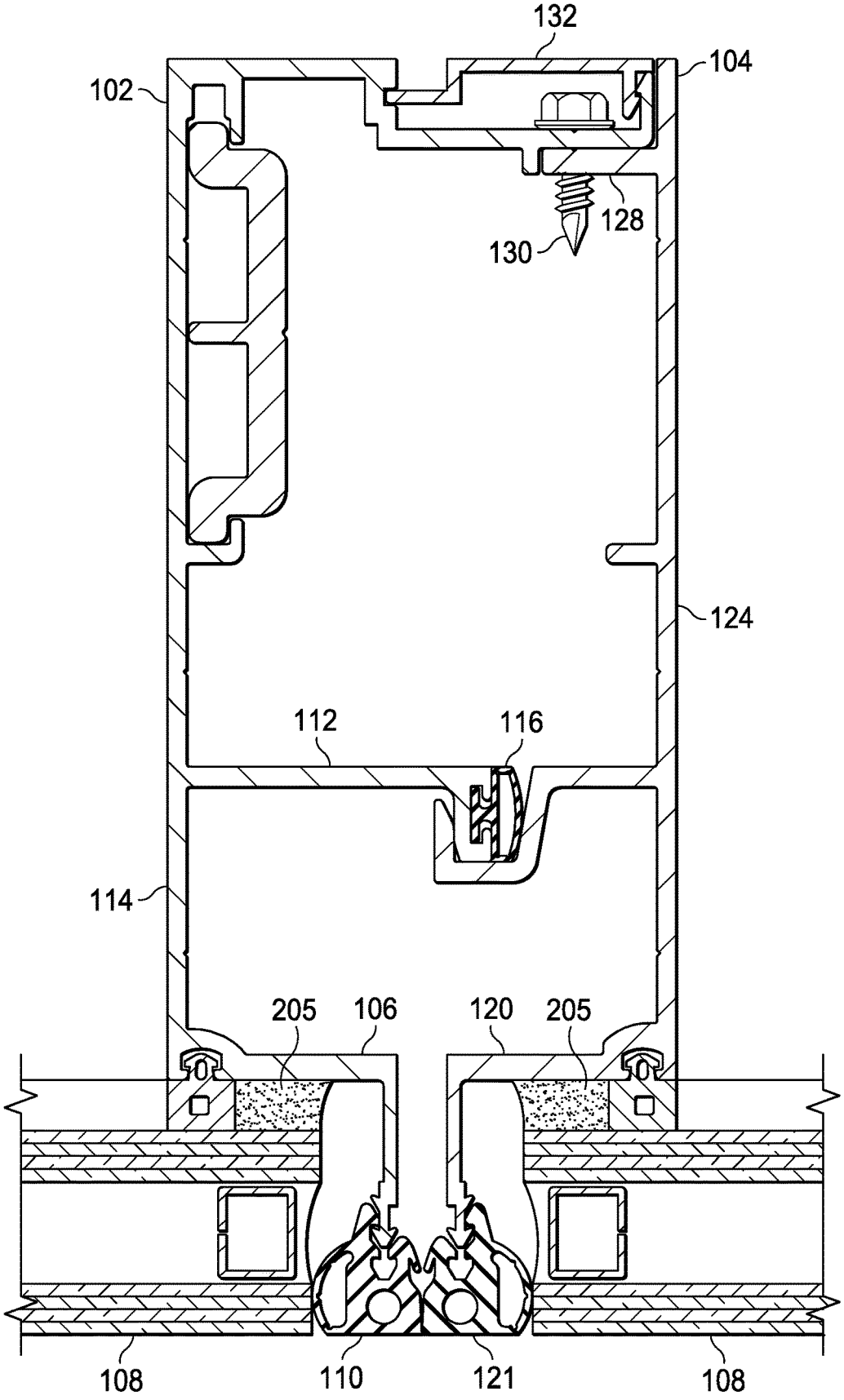
FIG. 2B is a top cross-sectional view of the split vertical member in an engaged configuration according to aspects of the disclosure illustrating use of structural silicone sealant adhesive.

Still referring to FIG. 2A, the at least one glazing panel 108 is illustrated as being coupled to the fixed portion 102 or the removable portion 104 utilizing, for example, the structural glazing tape 203, which has high bonding strength suitable for structural glazing applications. As illustrated in FIG. 2B, the at least one glazing panel 108 may be coupled to the fixed portion 102 or the removable portion 104 using a bead 205 of, for example, a structural adhesive such as, for example, structural silicone or other appropriate adhesive. In various embodiments, such adhesive could be, for example, a two-component neutral-cure, fast curing structural sealant intended for structural bonding of glass, metal, or other building components. In other embodiments, the adhesive could be, for example, a single-component adhesive.

Still referring to FIGS. 1A-2C, a pair of removable portions 104 define the vertical boundaries of a front-load bay 202 therebetween. During use, the front-load bay 202 facilitates out-of-sequence installation or removal of a section of the exterior wall system during, for example, building construction or equipment delivery. In various embodiments, the front-load bay 202 may be the width of a single glazing panel 108; however, in other embodiments, the front-load bay may include more than one linearly-aligned glazing panel 108. Thus, in various embodiments, the front-load bay 202 may include one or more vertical members disposed between the removable portions 104 thereby allowing the width of the front-load bay 202 to be defined according to construction and equipment requirements. Similarly, it should be appreciated that, depending on such requirements, the front-load bay may span multiple floors of a building or may be designed as a series of shorter front-load bays having the same or other heights. For example, such shorter front-load bays may all have approximately single-floor or other height, may be grouped into certain heights (e.g., that vary depending on location), or may have substantially different heights from one to the next.

Still referring to FIGS. 1A-2C, receipt of the second gasket 116 into the recessed portion 126 of the second removable flange 122 of the removable portion 104 facilitates sealing of the split vertical member 100 when the fixed portion 102 and the removable portion 104 are assembled. Furthermore, when the removable portion 104 is assembled to the fixed portion the first gasket 110 abuts the third gasket 121 in order to create a seal between the first gasket 110 and the third gasket 121. Thus, interaction of the first gasket 110 with the third gasket 121, as well as interaction of the second gasket 116 with the recessed portion 126, prevents air flow and the infiltration of water and other contaminants into an interior portion of the building.

Figure 2C:
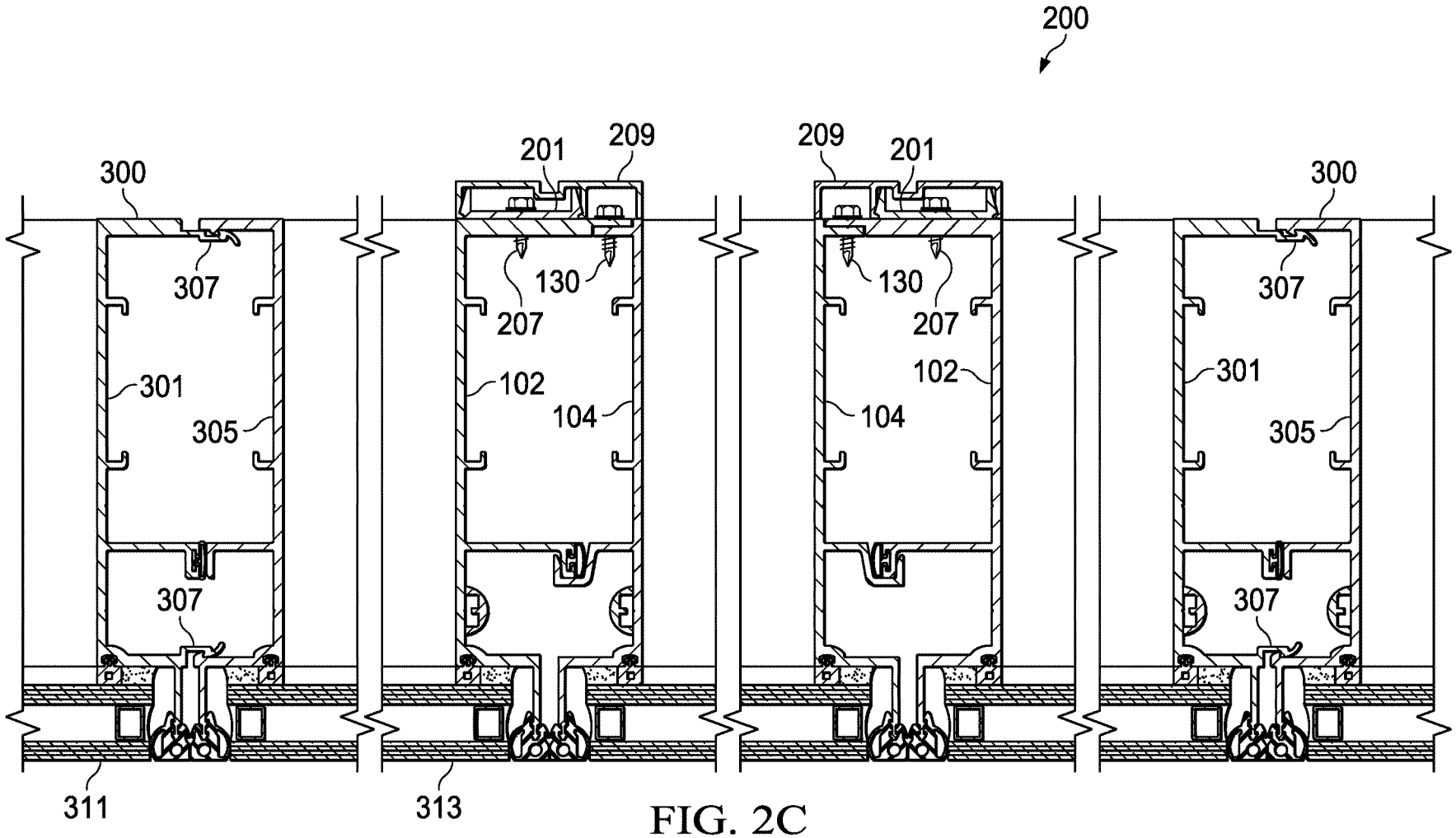
FIG. 2C is a top cross-sectional view of the split vertical member in an engaged configuration according to aspects of the disclosure illustrating use of structural silicone sealant adhesive.

FIG. 2C is a top cross-sectional view of the split vertical member 200 in an engaged configuration. For purposes of illustration, two split vertical members 200 are shown in use with vertical mullions 300 to demonstrate how the front-load bay 202 could be expanded laterally. In various embodiments, the split vertical member 200 is similar in construction and operation to the split vertical member 100. However, the split vertical member 100 utilizes a cover 132 that extends across approximately half of a width of the split vertical member 100. In contrast to the split vertical member 100, the split vertical member 200 includes a bracket 201 that is coupled to a rear aspect of the fixed portion 102 with a fastener 207 such as, for example, a screw. The bracket 201 facilitates attachment of a cover 209, which conceals the rear aspect of the fixed portion 102 and the removable portion 104 together with the fastener 130 and the fastener 207. Thus, the cover 209 extends across an entire width of the split vertical member 200.

Still referring to FIG. 2C, the split vertical member 200 is illustrated in use with vertical mullions 300. For purposes of illustration, the split vertical member 200 is shown in use with the vertical mullions 300; however, one skilled in the art will recognize that the split vertical member 100 could also be utilized in the manner illustrated in FIG. 2B as could any of the embodiments illustrated in FIGS. 1A-2C. The vertical mullion 300 includes a first portion 301 and a second portion 305 that is received into the first portion 301. The first portion 301 and the second portion 305 are coupled to each other by a plurality of snaps 307. In various embodiments, the snaps 307 secure the first portion 301 to the second portion 305 and prevent inadvertent disengagement of the second portion 305 from the first portion 301. Engagement of the first portion 301 and the second portion 305 facilitate modular installation of an exterior wall system such as, for example, a curtain-wall system or a window-wall system to an exterior of a building construction. Thus, the width of the front-load bay 202 may be expanded to encompass many vertical mullions 300 depending on the application requirements. When the front-load bay 202 is to be closed, a first glazing panel 311 is coupled to the vertical mullions 300. The first glazing panel 311 is bounded on a first side by the second portion 305 and is bounded on a second side by the fixed portion 102 of the split vertical mullion. A second glazing panel 313, which is bounded on both sides by the removable portion 104 is inserted between the fixed portions 102. Thus, the split vertical member 200 facilitates out-of-sequence assembly of the curtain wall.

Figure 3A:
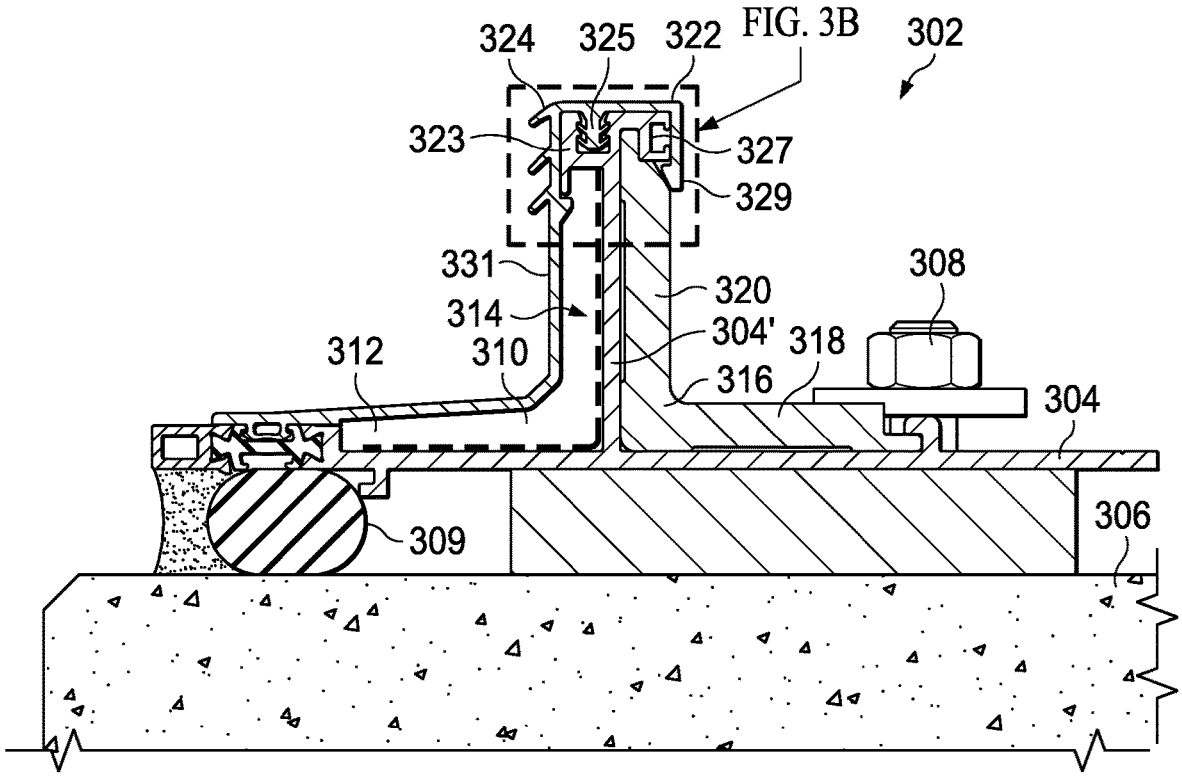
FIG. 3A is a side view of a sill starter according to aspects of the disclosure.
Figure 3B:
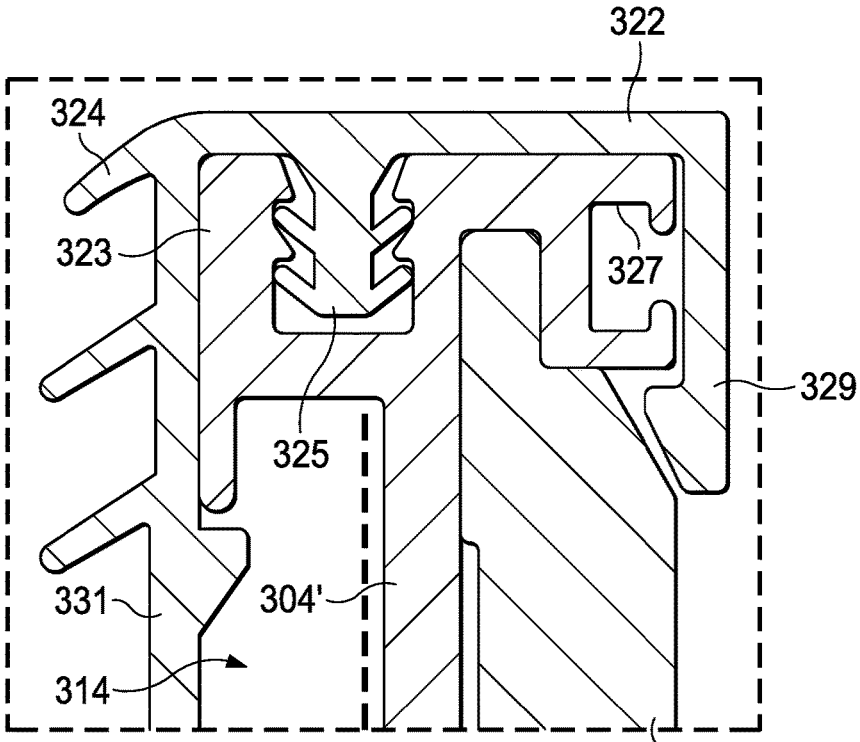
FIG. 3B is a detail view of the sill starter of FIG. 3A.

FIG. 3A is a side view of a sill starter 302. FIG. 3B is a detail view of the sill starter 302. Referring to FIGS. 3A-3B collectively, the sill starter 302 includes a base plate 304 that is arranged in a spaced relationship to a substrate 306 such as, for example, a slab. The base plate 304 is secured to the substrate 306 with an anchor 308 such as, for example, an imbedded bolt or a wedge anchor. Sealant 309 is arranged between the base plate 304 and the substrate 306 in an effort to prevent air flow and the infiltration of, for example, water and other contaminants under the base plate 304. An outer angular member 310 is arranged on the base plate 304. The outer angular member 310 includes a horizontal flange 312 that extends towards an exterior of the building and a vertical flange 314 that extends upwardly substantially perpendicular to the horizontal flange 312. In the embodiment shown in FIGS. 3A-3B, a vertical flange 304' extends upwardly from the base plate 304 and is substantially perpendicular thereto. The vertical flange 314 of the outer angular member 310 abuts the exterior-facing side of the vertical flange 304' of the base plate 304. An inner angular member 316 is arranged on the base plate 304 and abuts the interior-facing side of the vertical flange 304' of the base plate 304. The inner angular member 316 includes a horizontal flange 318 that extends towards the interior of the building and a vertical flange 320 that extends upwardly substantially perpendicular to the horizontal flange 318. The vertical flange 320 of the inner angular member 316 abuts the interior-facing side of the vertical flange 304' of the base plate 304. The vertical flange 314 of the outer angular member 310 and the vertical flange 320 of the inner angular member 316 are illustrated in FIGS. 3A-3B as being separated by the vertical flange 304' of the base plate 304; however, in other embodiments, the vertical flange 304' of the base plate 304 may be omitted, such that they may be in flush contact with each other or a space may be present between them. In other embodiments, a space may be present between the vertical flange 304' of the base plate 304 and one or more of the vertical flange 314 of the outer angular member 310 and the vertical flange 320 of the inner angular member 316. In other embodiments, one or more of the vertical flange 314 of the outer angular member 310, the vertical flange 320 of the inner angular member 316, and the vertical flange 304' of the base plate 304 may not be vertical but, instead be arranged at an angle relative to a vertical plane.

Still referring to FIGS. 3A-3B, a locking cap 322 is disposed on the vertical flange 304' of the base plate 304. The locking cap 322 includes ridges 324 extending outwardly therefrom. The locking cap 322 is illustrated in FIGS. 3A-3B as including three ridges 324; however, in other embodiments, the locking cap 322 may include any number of ridges 324 including, for example, more than or less than three or may have no ridges. A flange 323 is formed on the exterior-facing side of the vertical flange 304'. A tongue 325 extends downwardly from the locking cap 322 and is received between the flange 323 and the vertical flange 304' thereby securing the locking cap 322 in place. A groove 327 is formed on the interior-facing side of the vertical flange 304'. The groove 327 opens towards the interior-facing side of the vertical flange 304'. The locking cap 322 includes a downward-facing flange 329. When assembled, the downward-facing flange 329 extends over and conceals the groove 327. The locking cap 322 includes a facing 331 that extends over an exterior-facing side of the outer angular member 310. In various embodiments, the facing 331, the locking cap 322, and the downward-facing flange 329 facilitate appropriate gasket pressure being maintained between the locking cap 322 and a recess 412 of a horizontal member 402.

Figure 4:
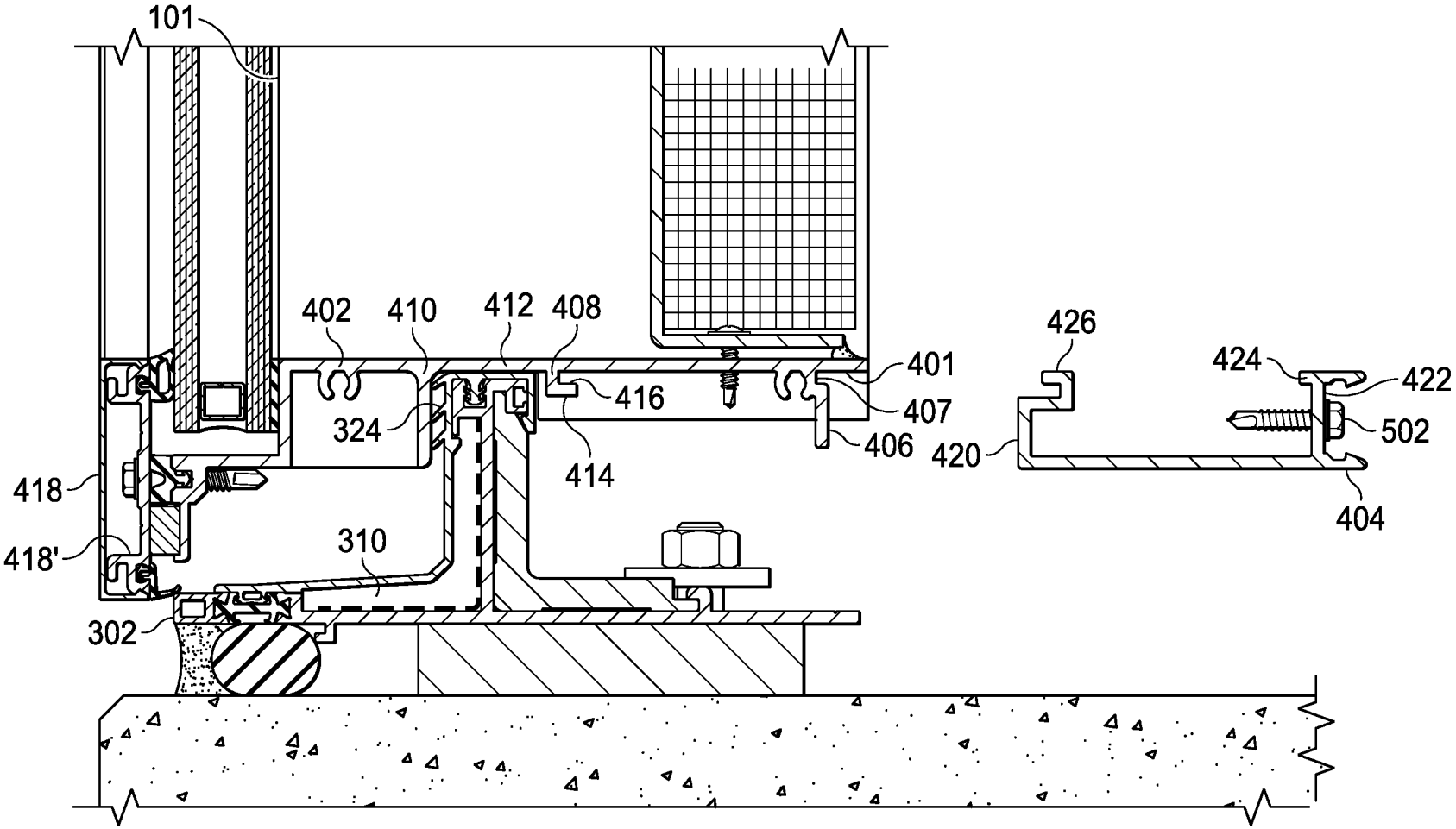
FIG. 4 is a side view of the sill starter showing a horizontal member positioned thereon with a disengaged locking member according to aspects of the disclosure.

FIG. 4 is a side view of the sill starter 302 showing a horizontal member 402 positioned thereon with a disengaged locking bracket 404. A bottom face 401 of the horizontal member 402 includes a first flange 406 extending downwardly therefrom. A first notch 407 is formed in the first flange 406. As shown, a second flange 408 extends from the bottom face 401 in an approximate center of the bottom face 401. In this embodiment, the second flange 408 is spaced from a third flange 410 by a distance slightly larger than the substantially horizontal segment of the locking cap 322 spanning the space between the exterior-facing side of the vertical flange 314 and the interior-facing side of the vertical flange 320 thereby creating a recess 412 between the second flange 408 and the third flange 410. Such spacing facilitates installation and removal of the front-load bay 202 by making it easier for the horizontal member 402 to be seated on,or lifted from, the sill starter 302 prior to engagement, or following disengagement, of the locking bracket 404. In this embodiment, the second flange 408 includes a horizontal web 414 that extends rearwardly (i.e. toward the building interior) from the second flange 408 generally parallel to a plane of the bottom face 401. Thus, a second notch 416 is defined between the bottom face 401 and the horizontal web 414. A front cover 418 is shown in a frictional-fit locking engagement with a frame component 418' that is fastened to an exterior aspect of the horizontal member 402.

Figure 5:
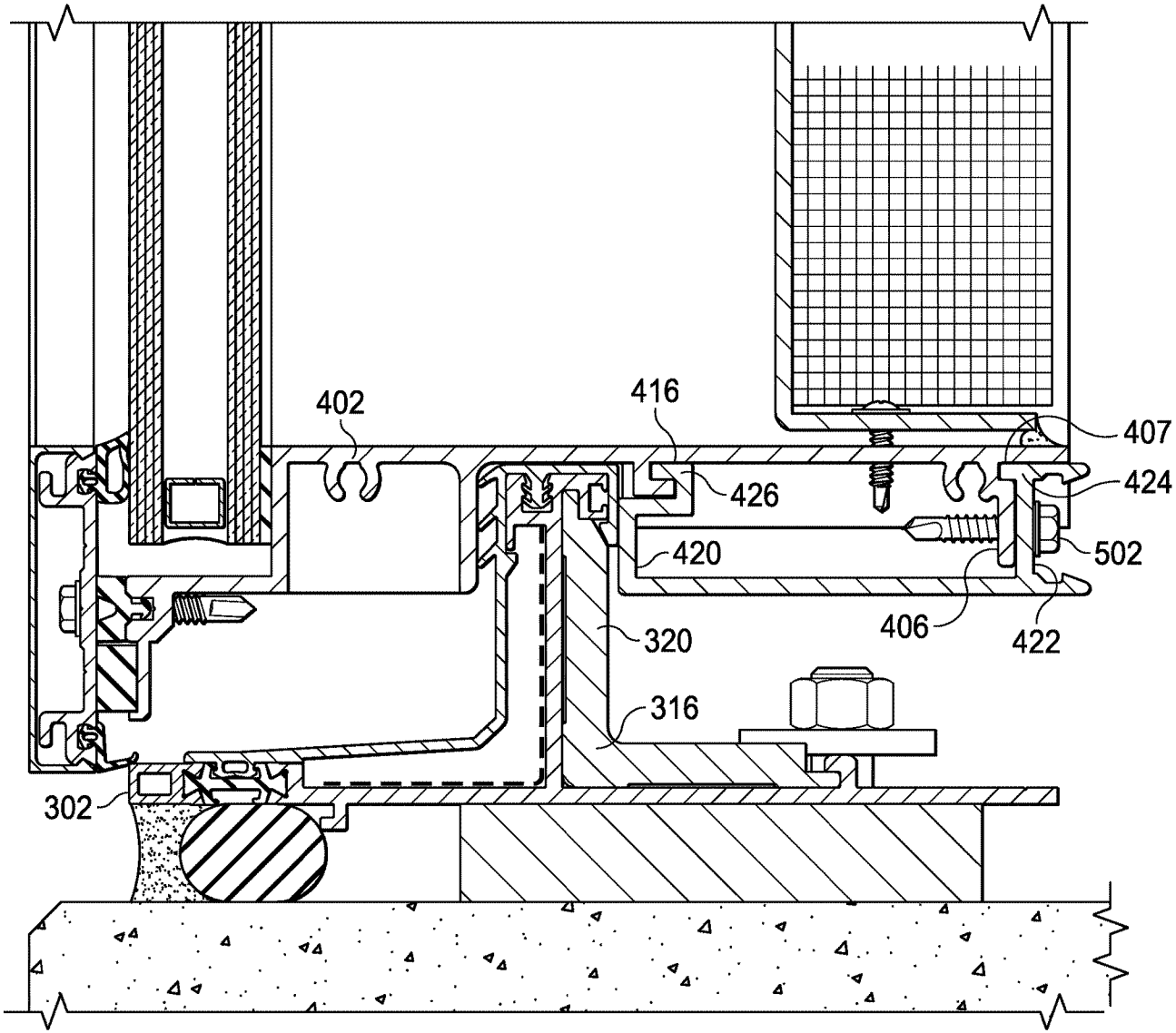
FIG. 5 is a side view of the sill starter showing a horizontal member positioned thereon with an engaged locking member according to aspects of the disclosure.

Still referring to FIG. 4, when assembled, the locking cap 322 is received into the recess 412. As shown in FIGS. 4-5, the ridges 324 of the locking cap 322 bear against the third flange 410 and create frictional resistance between the locking cap 322 and the locking bracket 404. In other embodiments, the ridges 324 of the locking cap 322 bear against the third flange 410 and create frictional resistance between the locking cap 322 and the third flange 410. The frame component 418' rests against at least one of the base plate 304 and the outer angular member 310 thereby providing angular support to the horizontal member 402.

Referring specifically to FIG. 4, the locking bracket 404 includes a vertical flange 420 that is spaced from a vertical flange 422. A first tab 424 extends inwardly from an upper aspect of the vertical flange 422. A second tab 426 is formed on an upper aspect of the vertical flange 420. In the embodiment illustrated in FIG. 4, the second tab 426 is offset rearwardly from the vertical flange 420; however, in other embodiments, the second tab 426 may not be offset from the vertical flange 420.

In various embodiments, the locking bracket 404 may be omitted as a separable element and may be integral with the horizontal member. Such embodiments would be utilized in applications where there is sufficient vertical clearance to allow the locking cap 322 of the sill starter 302 to be received into the recess 412 of the horizontal member 402.

FIG. 5 is a side view of the sill starter 302 showing the horizontal member 402 positioned thereon with an engaged locking bracket 404. When assembled, the vertical flange 420 bears against the vertical flange 320 of the inner angular member 316 and the second tab 426 is received into the second notch 416. The vertical flange 422 contacts the first flange 406 and is secured to the first flange 406 with a fastener 502. In various embodiments, the fastener 502 may be, for example, a threaded fastener such as, for example, a screw or a bolt; however, in other embodiments, the fastener 502 may be, for example, a rivet, a friction pin, a clamp, a clip, or any other appropriate type of fastener. Additionally or alternatively, the exterior-facing vertical flange 422 may be secured to the first flange 406 via other securement means such as welding, brazing, soldering, adhesives (e.g., epoxy, polyurethane, or cyanoacrylate), nanoscale sculpturing, or any other means capable of withstanding the applicable design loads. The choice of securement means would take into account whether any future disassembly needs to be accommodated. The first tab 424 is received into the first notch 407. Thus, when assembled, the locking bracket 404 supports an interior aspect of the horizontal member 402 and prevents disengagement of the horizontal member 402 from the sill starter 302.

Referring to FIGS. 1A-5 collectively, during use, the sill starter is positioned horizontally along a bottom aspect of the front-load bay 202 between two adjacent split vertical members 100. When it is desired to assemble the front-load bay 202, the wall section 101 having the horizontal member 402 disposed across a bottom aspect thereof is aligned with the sill starter 302. The sill starter 302 engages the horizontal member 402 and thereby supports the wall section 101. The locking bracket 404 is secured to the horizontal member 402 with the fastener 502 in order to secure the horizontal member 402 to the sill starter 302. The removable portion 104 of the split vertical member 100 is pressed into engagement with the fixed portion of the split vertical member 100 and is secured thereto with at least one fastener 130. The front-load bay 202 may be disassembled by reversing these steps (e.g., to install large equipment post-construction).

Figure 6A:
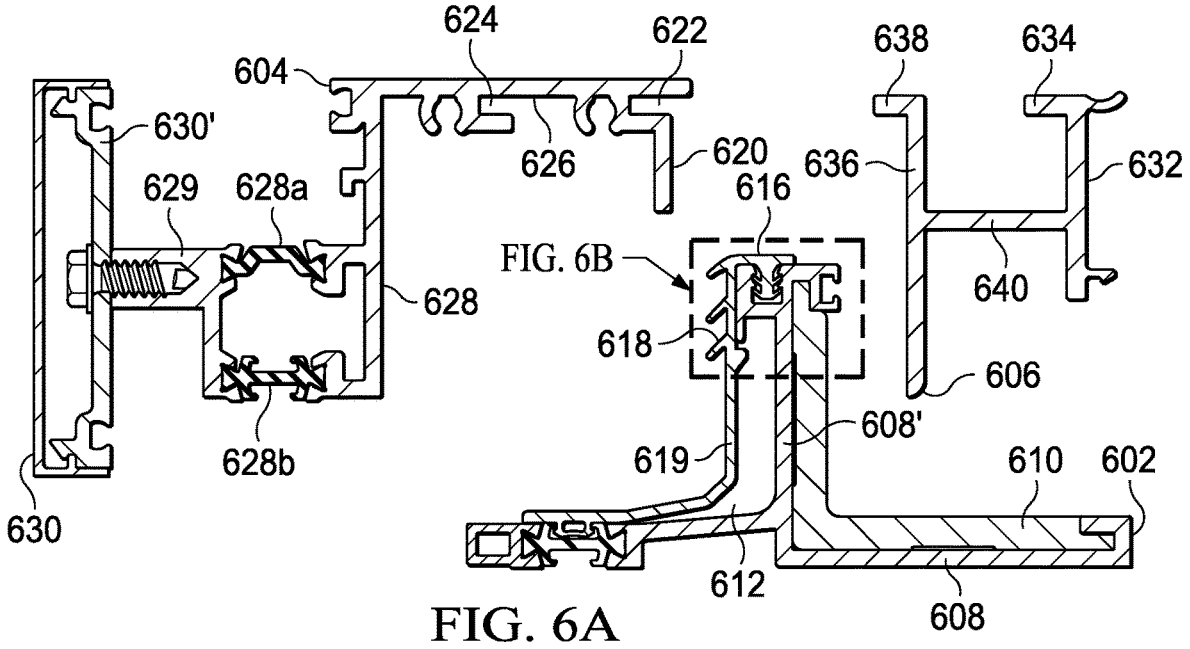
FIG. 6A is an exploded view of an intermediate stack and a horizontal member with a locking bracket according to aspects of the disclosure.
Figure 6B:
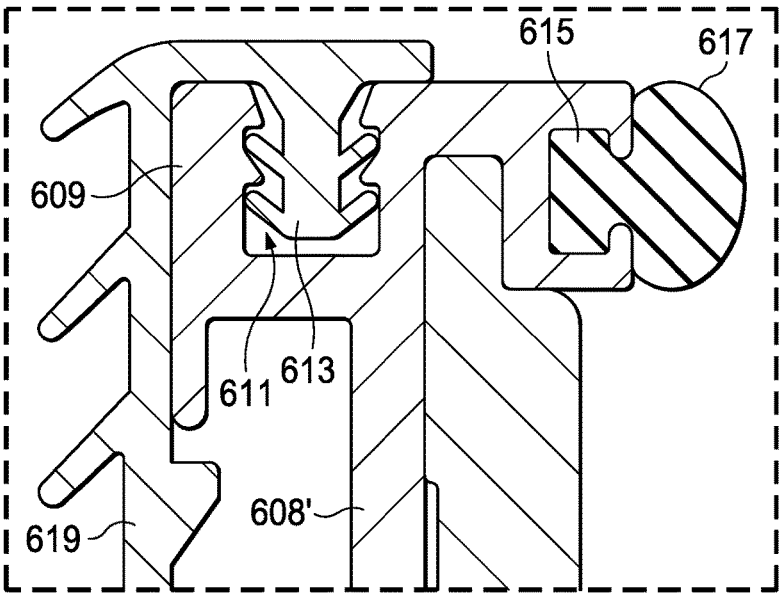
FIG. 6B is a detail view of the intermediate stack of FIG. 6A.

FIG. 6A is an exploded view of an intermediate stack 602 and a horizontal member 604 with a locking bracket 606. FIG. 6B is a detail view of the intermediate stack 602. Referring to FIGS. 6A and 6B collectively, the intermediate stack 602 is similar in construction to the sill starter 302 and includes a base plate 608 that has in inner angular member 610 and an outer angular member 612 that are similar in construction to the inner angular member 316 and the outer angular member 310 described above. In the embodiment shown in FIGS. 6A-6B, a vertical flange 608' extends upwardly from the base plate 608 and is substantially perpendicular thereto. A locking cap 616 is positioned at an upper aspect of the vertical flange 608'. The locking cap 616 includes ridges 618 extending therefrom.

Still referring to FIGS. 6A-6B, a flange 609 extends from the vertical flange 608' on an exterior-facing side of the intermediate stack 602. A groove 611 is defined between the flange 609 and the vertical flange 608'. A tongue 613 extends downwardly from the locking cap 616 and is received into the groove 611 thereby securing the locking cap 616 in place. A channel 615 is formed on an inward-facing side of the intermediate stack 602 and extends from the vertical flange 608'. A gasket 617 is secured in the channel 615 via, for example, frictional engagement. The locking cap 616 includes a facing 619 that extends over an exterior-facing side of the outer angular member 612.

Still referring to FIGS. 6A-6B, the horizontal member 604 includes a first flange 620 having a first notch 622 formed therein. A second notch 624 is formed in a horizontal face 626 of the horizontal member 604. A second flange 628 extends downwardly from the horizontal face 626. A front cover 630 is shown in a frictional-fit locking engagement with a frame component 630' that is fastened to a support flange 629 that extends outwardly from the second flange 628 and is connected to second flange 628 by thermal barrier 628*a* and thermal barrier 628*b*. The thermal barrier 628*a* and the thermal barrier 628*b* are designed to reduce conductive heat transfer between the support flange 629 and the second flange 628. The thermal barrier 628*a* and the thermal barrier 628*b* may be formed of a substantially thermally non-conductive material such as, for example, polyvinyl chloride (PVC), plastic, rubber, or other insulating materials, including composite materials. In other embodiments, the second flange 628 and the support flange 629 may be connected with any number of thermal barriers or may be integrally formed without any thermal barriers.

Still referring to FIGS. 6A-6B, the locking bracket 606 includes a first vertical member 632 having a first tab 634 formed on an upper aspect thereof. A second vertical member 636 includes a second tab 638 formed on an upper aspect thereof. The first vertical member 632 and the second vertical member 636 are joined by a web 640.

In various embodiments, the locking bracket 606 may be omitted as a separable element and may be integral with the horizontal member 604. Such embodiments would be utilized in applications where there is sufficient vertical clearance to allow the locking cap 616 of the intermediate stack 602 to be received between the second flange 628 of the horizontal member 604 and the second vertical member 636 of the locking bracket 606.

Figure 7A:
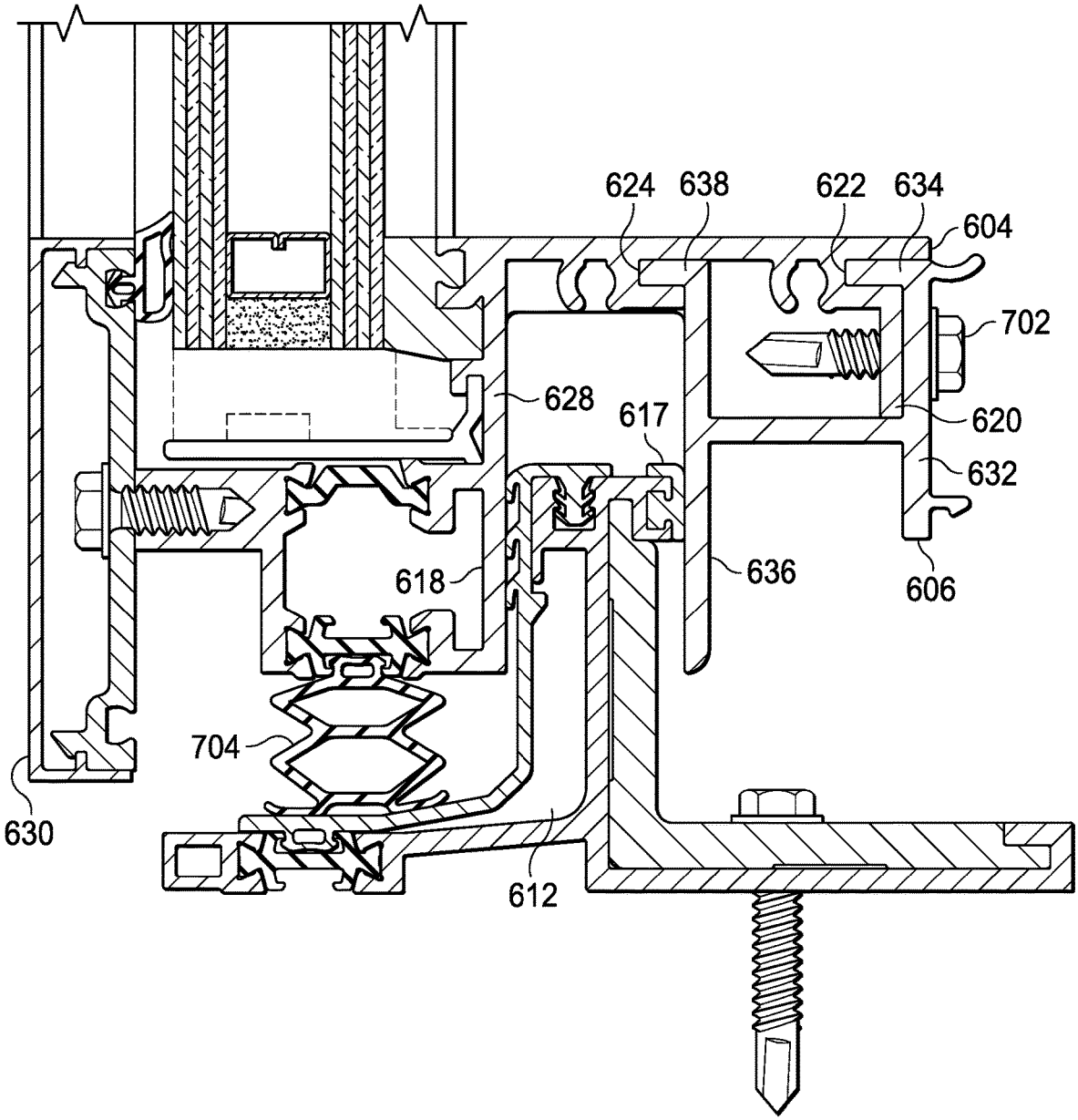
FIG. 7A is a cross-sectional view of the intermediate stack, the horizontal member, and the locking bracket according to aspects of the disclosure.

FIG. 7A is cross-sectional view of the intermediate stack 602, the horizontal member 604, and the locking bracket 606 using structural glazing tape. When assembled, the second flange 628 bears against the outer angular member 612 with the locking cap 616 positioned between the second flange 628 and the outer angular member 612. The ridges 618 facilitate creation of a frictional engagement between the outer angular member 612 and the second flange 628 when the locking bracket 606 is fastened or otherwise secured to the horizontal member 604. The second vertical member 636 bears against and compresses the gasket 617. The second tab 638 engages the second notch 624 and the first tab 634 engages the first notch 622. The first vertical member 632 bears against the first flange 620 and is secured thereto by a fastener 702. In various embodiments, the fastener 702 may be, for example, a threaded fastener such as, for example, a screw or a bolt; however, in other embodiments, the fastener 702 may be, for example, a rivet, a friction pin, a clamp, a clip, or any other appropriate type of fastener. Additionally or alternatively, the first vertical member 632 may be secured to the first flange 620 via other securement means such as welding, brazing, soldering, adhesives (e.g., epoxy, polyurethane, cyanoacrylate), nanoscale sculpturing, or any other means capable of withstanding the applicable design loads. The choice of securement means would take into account whether any future disassembly need be accommodated. In various embodiments, thermal insulation 704 may be positioned between the front cover 630 and the outer angular member 612. Thus, securement of the locking bracket 606 to the horizontal member 604 secures the horizontal member 604 to the intermediate stack 602.

Figure 7B:
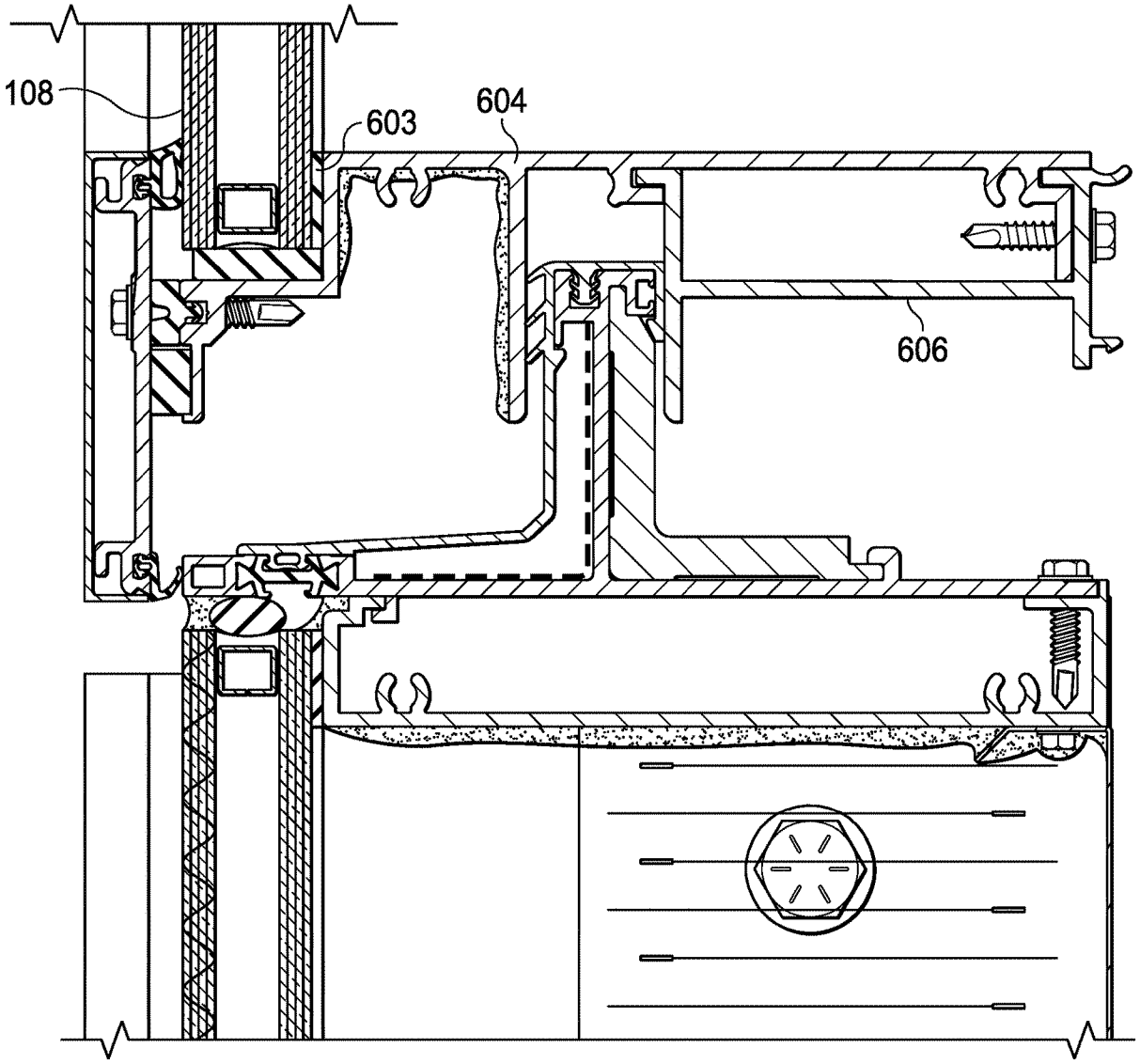
FIG. 7B is a cross-sectional view of an intermediate stack assembled to a horizontal member showing use of structural glazing tape and a captured glazing panel according to aspects of the disclosure.
Figure 7C:
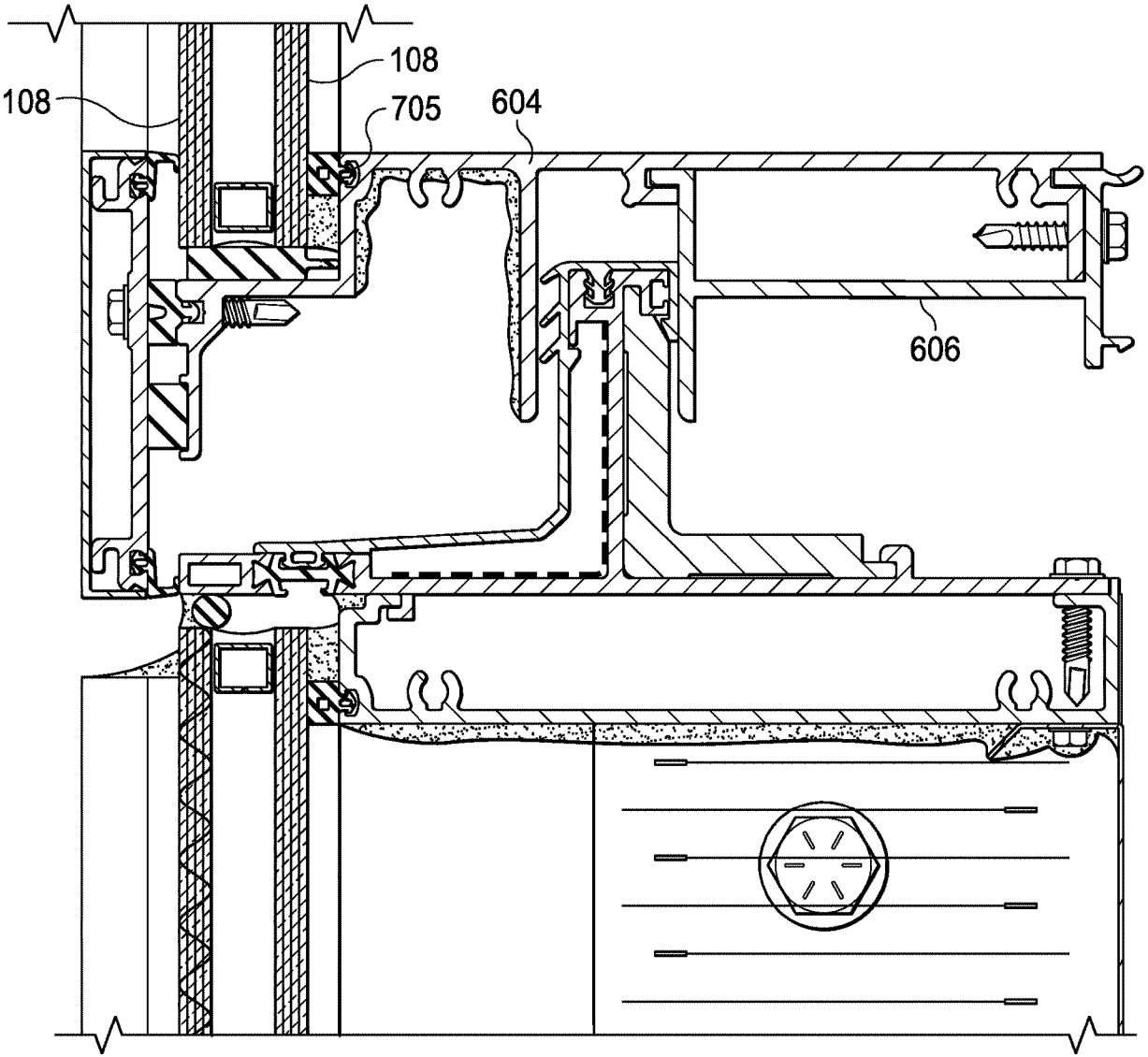
FIG. 7C is a cross-sectional view of an intermediate stack assembled to a horizontal member showing use of structural silicone sealant adhesive and a captured glazing panel according to aspects of the disclosure.
Figure 7D:
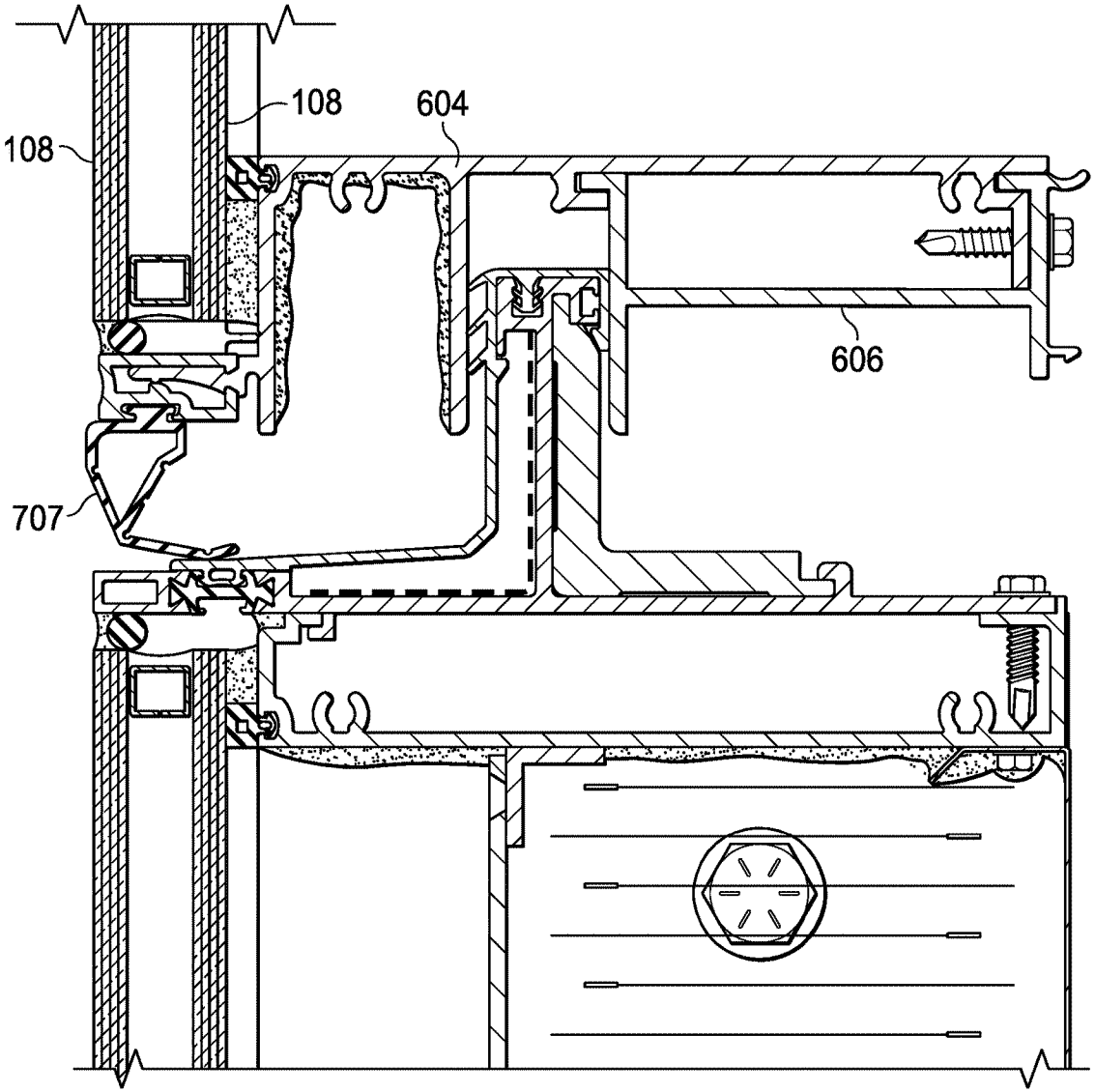
FIG. 7D is a cross-sectional view of an intermediate stack assembled to a horizontal member showing a non-captured glazing panel according to aspects of the disclosure.

Referring now to FIG. 7B, the at least one glazing panel 108 is illustrated as being coupled to the horizontal member 604 utilizing, for example, structural glazing tape 603 with high bonding strength suitable for structural glazing applications. As illustrated in FIG. 7C, the at least one glazing panel 108 may be coupled to the horizontal member 604 using a bead 705 of, for example, a structural adhesive such as, for example, structural silicone or other appropriate adhesive. In various embodiments, such adhesive could be, for example, a two-component neutral-cure, fast curing structural sealant intended for structural bonding of glass, metal, or other building components. In other embodiments, the adhesive could be, for example, a single-component adhesive. FIGS. 7A-7C illustrate an embodiment having a captured glazing panel 108. In such an embodiment the front cover 630 is coupled to the horizontal member 604 and is positioned outwardly of the glazing panel 108. FIG. 7D illustrates an embodiment having a non-captured glazing panel 108. In such an embodiment a rain screen 707 is coupled to the horizontal member 604 below the glazing panel 108. In various embodiments, the rain screen 707 is constructed of a thermally non-conductive material such as, for example, EPDM, silicone, or extruded rubber. Use of the rain screen 707 achieves a desired exterior aesthetic and improves thermal performance.

Figure 8:
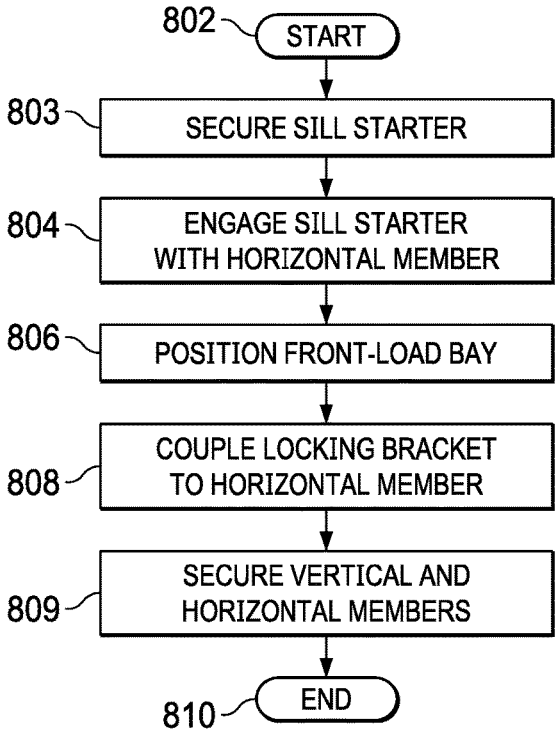
FIG. 8 is a flow diagram illustrating a process for installing a ground-floor segment of a front-load bay according to aspects of the disclosure.

FIG. 8 is a flow diagram illustrating a process 800 for installing a ground-floor segment of the front-load bay 202. The process 800 begins at step 802. At step 803, the sill starter 302 is secured, for example, to a building slab. At step 804 the sill starter 302 engages the recess 412 formed in the bottom face 401 of the horizontal member 402. At step 806, the front-load bay 202 is manipulated such that the removable portion 104 of the split vertical member 100 is coupled to the fixed portion 102 of the split vertical member 100. In various embodiments, step 806 is accomplished by rotating the front-load bay 202 upwardly about the horizontal member 402 until the removable portion 104 of the split vertical member 100 is coupled to the fixed portion 102 of the split vertical member 100. In other embodiments, the removable portion 104 is moved horizontally into engagement with the fixed portion 102. In various embodiments, the removable portion 104 of the split vertical member 100 is coupled to the fixed portion 102 of the split vertical member 100 via the fastener 130. In step 808, the locking bracket 404 is coupled to the horizontal member 402 to secure the horizontal member 402 to the sill starter 302. In various embodiments, the locking bracket 404 is secured to the horizontal member 402 via the fastener 502. In various embodiments, step 808 may be omitted in applications where sufficient vertical clearance exists to allow the sill starter 302 to be received into the recess 412. In such embodiments, the locking bracket 404 may be integrally formed with the horizontal member 402. At step 809, the removable portion 104 of the split vertical member 100 is coupled to the fixed portion 102 of the split vertical member 100 via the fastener 130. Additionally, an upper horizontal member is secured. The process 800 ends at step 810.

Figure 9:
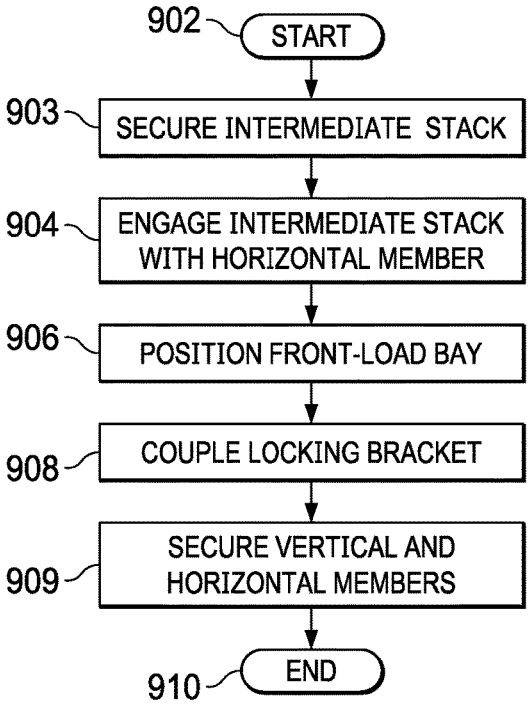
FIG. 9 is a flow diagram illustrating a process for installing an upper-floor segment of a front-load bay according to aspects of the disclosure.

FIG. 9 is a flow diagram illustrating a process 900 for installing an upper-floor segment of the front-load bay 202. The process 900 begins at step 902. At step 903, the intermediate stack 602 is secured, for example, to an uppermost horizontal member of a lower adjacent segment of the front-load bay 202. At step 904 the intermediate stack 602 engages the horizontal member 604. In various embodiments, the horizontal member 604 engages an anchor, which carries a weight of the front-load bay 202. At step 906, the front-load bay 202 is manipulated such that the removable portion 104 of the split vertical member 100 is coupled to the fixed portion 102 of the split vertical member 100. In various embodiments, step 906 is accomplished by rotating the front-load bay 202 upwardly about the horizontal member 604 until the removable portion 104 of the split vertical member 100 is coupled to the fixed portion 102 of the split vertical member 100. In other embodiments, the removable portion 104 is moved horizontally into engagement with the fixed portion 102. In various embodiments, the removable portion 104 of the split vertical member 100 is coupled to the fixed portion 102 of the split vertical member 100 via the fastener 130. In step 908, the locking bracket 606 is coupled to the horizontal member 604 to secure the horizontal member 604 to the intermediate stack 602. At step 909, the locking bracket 606 is secured to the horizontal member 604 via the fastener 702. Additionally, an upper horizontal member is secured. In various embodiments, step 909 may be omitted in applications where sufficient vertical clearance exists to allow the intermediate stack 602 to engage the horizontal member 604. In such embodiments, the locking bracket 606 may be integrally formed with the horizontal member 604. The process 900 ends at step 910.

Figure 10:
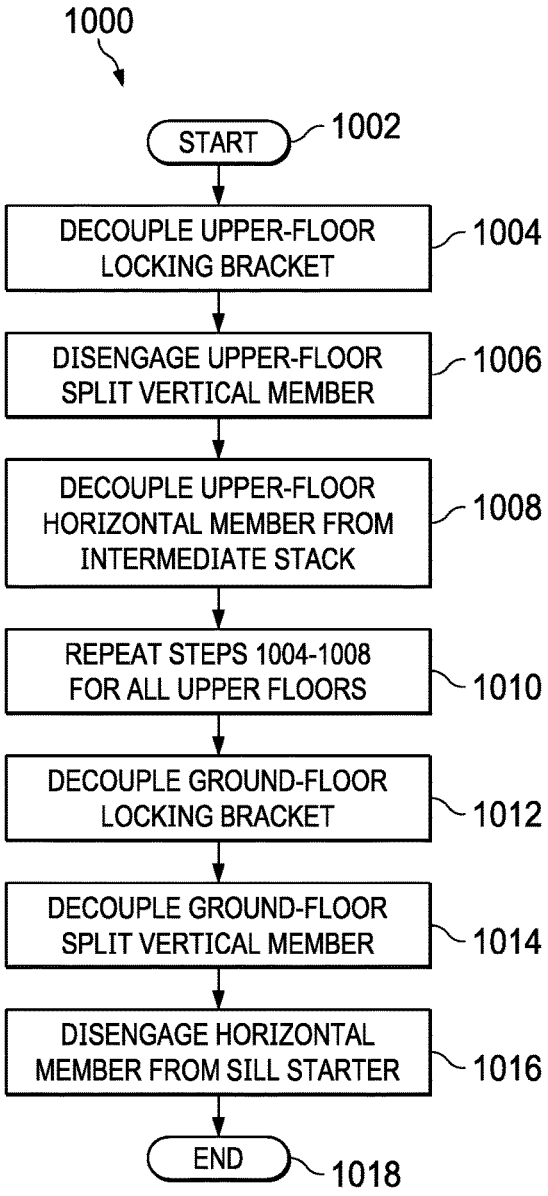
FIG. 10 is a flow diagram illustrating a process for disassembling a front-load bay according to aspects of the disclosure.

FIG. 10 is a flow diagram of a process 1000 for removing a front-load bay 202. The process 1000 begins at step 1002. At step 1004, the locking bracket 606 is decoupled from the horizontal member 604 corresponding to an upper-floor segment of the front-load bay 202. At step 1006, the removable portion 104 of the split vertical member 100 is decoupled from the fixed portion 102 of the split vertical member 100. At step 1008, the horizontal member 604 is decoupled from the intermediate stack 602 and the upper-floor segment of the front-load bay 202 is removed via, for example, a crane. In various embodiments, the horizontal member 604 is decoupled from an anchor, which carries a weight of the front-load bay 202. At step 1010, step 1004 through step 1008 are repeated for each upper-floor segment of the front-load bay 202. At step 1012, the locking bracket 404 is decoupled from the horizontal member 402 corresponding to the ground floor segment of the front-load bay 202. At step 1014, the removable portion 104 of the split vertical member 100 is decoupled from the fixed portion of the split vertical member 100. At step 1016, the horizontal member 402 is disengaged from the sill starter 302 and the ground-floor segment of the front-load bay is removed via, for example, a crane. The process 1000 ends at step 1018.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," "generally," and "about" may be substituted with "within [a percentage] of" what is specified.

Unless otherwise indicated expressly or by implication from context, the term "or" is defined inclusively, such that, for example, the expression "A or B" means "A" or "B" or "A and B."

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. An exterior wall system comprising:

a pair of split vertical members that are separated by a glazing panel;

a front-load bay defined between the pair of split vertical members, the front-load bay comprising a horizontal member disposed along a bottom edge of the front-load bay, each split vertical member comprising:

a removable portion coupled to the glazing panel;

a fixed portion coupled to an adjacent section of the exterior wall system;

wherein the removable portion may be selectively coupled to the fixed portion to facilitate assembly of the front-load bay to the adjacent section of the exterior wall system;

a sill starter disposed horizontally between the pair of split vertical members below the front-load bay; and wherein the horizontal member engages with the sill starter to facilitate support of the front-load bay.

2. The exterior wall system of claim 1, wherein the front-load bay is formed in a curtain wall.

3. The exterior wall system of claim 1, wherein the front-load bay is formed in a window wall.

4. The exterior wall system of claim 1, wherein the sill starter comprises:

a base plate;

an inner angular member disposed on the base plate;

an outer angular member disposed on the base plate, the outer angular member abutting the inner angular member; and a locking cap that couples the inner angular member to the outer angular member.

5. The exterior wall system of claim 4, wherein the horizontal member comprises:

a bottom face;

a first flange extending from the bottom face;

a second flange extending from the bottom face; and a third flange extending from the bottom face, the second flange and the third flange together defining a recess that receives the locking cap of the sill starter.

6. The exterior wall system of claim 5, comprising a locking bracket removably coupled to the horizontal member.

7. The exterior wall system of claim 6, wherein the locking bracket secures the horizontal member to the sill starter.

8. The exterior wall system of claim 1, wherein the fixed portion of the split vertical member comprises:

a first flange extending from a body section;

a second flange extending from the body section, the second flange having a recess formed therein; and a third flange extending from the body section.

9. The exterior wall system of claim 8, wherein the removable portion of the split vertical member comprises:

a first removable flange extending from a body section, the first flange aligning with the first flange of the fixed portion when the removable portion is assembled to the fixed portion;

a second removable flange extending from the body section, the second flange having a second gasket associated therewith that, when assembled is received into the recess; and a third removable flange extending from the body section, the third flange aligning with the third flange of the fixed portion when the removable portion is assembled to the fixed portion.

10. An exterior wall front-load bay, comprising:

a horizontal member disposed along a bottom edge of the exterior wall front-load bay, the horizontal member having a recess formed in a bottom face thereof;

a sill starter spanning the front-load bay horizontally and positioned below the horizontal member, the sill starter comprising:

a base plate arranged in a spaced relationship to a substrate;

an inner angular member positioned above the base plate, and that abuts the base plate;

an outer angular member positioned above the base plate and that abuts the inner angular member and the base plate;

a locking cap that joins the inner angular member and the outer angular member, the locking cap being received into the recess; and a locking bracket coupled to the horizontal member and secures the horizontal member to the sill starter.

11. The exterior wall front-load bay of claim 10, wherein the front-load bay is formed in a curtain wall.

12. The exterior wall front-load bay of claim 10, wherein the front-load bay is formed in a window wall.

13. The exterior wall front-load bay of claim 10, wherein the horizontal member comprises:

a first flange extending from the bottom face;

a second flange extending from the bottom face; and a third flange extending from the bottom face, the second flange and the third flange together defining the recess that receives the locking cap of the sill starter.

14. The exterior wall front-load bay of claim 10, comprises a split vertical member disposed along a vertical edge of the front-load bay, the split vertical member comprising a fixed portion and a removable portion.

15. The exterior wall front-load bay of claim 14, wherein the fixed portion of the split vertical member comprises:

a first flange extending from a body section;

a second flange extending from the body section, the second flange having a recess formed therein; and a third flange extending from the body section.

16. The exterior wall system of claim 15, wherein the removable portion of the split vertical member comprises:

a first removable flange extending from a body section, the first flange aligning with the first flange of the fixed portion when the removable portion is assembled to the fixed portion;

a second removable flange extending from the body section, the second flange having a second gasket associated therewith that, when assembled is received into the recess; and a third removable flange extending from the body section, the third flange aligning with the third flange of the fixed portion when the removable portion is assembled to the fixed portion.

17. A split vertical member for use in an exterior wall system, the split vertical member comprising:

a removable portion;

a fixed portion that receives the removable portion and is operatively coupled to the removable portion;

the fixed portion comprising:

a first flange extending from a body section;

a second flange extending from the body section, the second flange having a recess formed therein; and a third flange extending from the body section;

the removable portion comprising:

a first removable flange extending from a body section, the first removable flange aligning with the first flange of the fixed portion when the removable portion is assembled to the fixed portion;

a second removable flange extending from the body section, the second removable flange having a second gasket associated therewith that, when assembled is received into the recess; and a third removable flange extending from the body section, the third removable flange aligning with the third flange of the fixed portion when the removable portion is assembled to the fixed portion.

18. The split vertical member of claim 17, wherein the split vertical member defines a vertical boundary of a front-load bay.

19. The split vertical member of claim 18, wherein the front-load bay is formed in a curtain wall.

20. The split vertical member of claim 18, wherein the front-load bay is formed in a window wall.

* * * * *